US007210698B2

(12) United States Patent
Dandurand

(10) Patent No.: US 7,210,698 B2
(45) Date of Patent: May 1, 2007

(54) SKI BINDING

(76) Inventor: Louis Dandurand, 1904 Hazens Notch Rd., Montgomery Center, VT (US) 05471-3090

( * ) Notice: Subject to any disclaimer, the term of this patent is extended or adjusted under 35 U.S.C. 154(b) by 199 days.

(21) Appl. No.: 10/799,305

(22) Filed: Mar. 12, 2004

(65) Prior Publication Data

US 2004/0173995 A1 Sep. 9, 2004

Related U.S. Application Data

(63) Continuation-in-part of application No. 10/229,152, filed on Aug. 27, 2002, now Pat. No. 6,877,759.

(51) Int. Cl.
*A63C 9/00* (2006.01)

(52) U.S. Cl. ..... 280/614; 280/615; 280/623; 280/628

(58) Field of Classification Search ..... 280/604, 280/605, 607, 611, 613, 614, 615, 621, 623, 280/624, 634, 628, 14.21; D21/766, 773, D21/771

See application file for complete search history.

(56) References Cited

U.S. PATENT DOCUMENTS

| | | | | |
|---|---|---|---|---|
| 3,647,233 A | | 3/1972 | Martin | |
| 3,907,319 A | | 9/1975 | Berlied, Jr. | |
| 3,989,273 A | | 11/1976 | Schmidt | |
| 4,230,338 A | | 10/1980 | Weigl et al. | |
| 4,533,154 A | | 8/1985 | Bernard et al. | |
| 4,659,103 A | | 4/1987 | Tessaro | |
| 4,836,572 A | | 6/1989 | Pozzobon | |
| 4,913,455 A | | 4/1990 | Salsetti et al. | |
| 4,917,399 A | | 4/1990 | Holzl | |
| 5,193,840 A | * | 3/1993 | Spitaler et al. | 280/615 |
| 5,338,053 A | | 8/1994 | Hauglin | |
| 5,498,017 A | * | 3/1996 | Rohrmoser | 280/633 |
| 5,551,721 A | | 9/1996 | Renaud-Goud et al. | |
| D375,773 S | * | 11/1996 | Haughlin | D21/773 |
| 5,957,478 A | * | 9/1999 | Vigny | 280/615 |
| 5,997,026 A | | 12/1999 | Klubitschko et al. | |
| D425,162 S | * | 5/2000 | Hauglin | D21/773 |
| 6,092,830 A | * | 7/2000 | Wheeler | 280/624 |
| 6,105,994 A | * | 8/2000 | Parris et al. | 280/614 |
| 6,196,570 B1 | * | 3/2001 | Klubitschko | 280/625 |

(Continued)

FOREIGN PATENT DOCUMENTS

AT 375835 B 9/1984

(Continued)

*Primary Examiner*—Christopher Bottorff
(74) *Attorney, Agent, or Firm*—David M. Driscoll

(57) ABSTRACT

A step-in binding for receiving a ski boot and preferably for telemark skiing. The binding includes a base constructed and arranged to be secured to the ski and a pair of boot support members pivotally supported from a front side of the base, and disposed laterally on either side of the base. The lateral side members may be tapered inwardly toward the front so as to receive and guide the ski boot as it is to be engaged. The pair of boot support members are biased to a boot receiving position and further having a locked position that is assumed once the boot is received, engages the pair of boot support members, and is cantilevered downwardly into the locked position.

54 Claims, 12 Drawing Sheets

U.S. PATENT DOCUMENTS

| | | | | |
|---|---|---|---|---|
| 6,299,193 | B1 * | 10/2001 | Parris et al. | 280/614 |
| 6,308,979 | B1 * | 10/2001 | Ludlow | 280/615 |
| 6,322,095 | B1 * | 11/2001 | Wheeler | 280/613 |
| 6,409,204 | B1 * | 6/2002 | Ayliffe | 280/613 |
| 6,623,027 | B1 | 9/2003 | Wheeler | |

FOREIGN PATENT DOCUMENTS

| | | | |
|---|---|---|---|
| AT | 386127 | B | 7/1988 |
| DE | 2906520 | A | 8/1980 |
| EP | 0176951 | A | 4/1986 |

* cited by examiner

SKI BINDING

RELATED APPLICATIONS

This application is a continuation-in-part of U.S. patent application Ser. No. 10/229,152 filed Aug. 27, 2002 now U.S. Pat. No. 6,877,759.

BACKGROUND OF THE INVENTION

The present invention relates in general to ski bindings, and pertains, more particularly, to ski bindings that are preferably used with a Telemark ski.

One traditional Telemark ski binding employs a front latch for securing the boot in the binding. This is typically referred to as a three pin 75 mm Nordic Norm binding. These types of bindings have traditionally required the skier to bend down and manually press down upon a latch mechanism at the front of the toe of the ski boot to attach the ski boot to the binding. This is a rather cumbersome arrangement, and it is time consuming in engaging the ski boot with the binding.

Another traditional Telemark binding employs a heel cable to secure the boot to the binding. This also is a cumbersome arrangement requiring time consuming positioning and adjustment for proper securing of the ski boot to the binding. Also, the cable may affect the overall flexibility and use of the ski by the skier.

It is an object of the present invention to provide an improved ski binding, preferably for use with a Telemark ski and in which the binding is a step-in binding.

Another object of the present invention is to provide a ski binding that is of the step-in type and that comprises a toe piece that readily accepts and engages the ski boot and provides means for simple and ready disengagement.

Still another object of the present invention is to provide a ski binding with an integral ski brake that deploys to arrest the forward movement of the ski when a skier steps out of the binding, particularly a binding for telemark skiing.

SUMMARY OF THE INVENTION

In accordance with the present invention there is provided a step-in binding for receiving a ski boot, comprising: a base constructed and arranged to be secured to the ski; and a pair of boot support members pivotally supported from a front side of the base, and disposed laterally on either side of the base. The pair of boot support members is biased to a boot receiving or open position and further has a locked or closed position that is assumed once the boot is received, engages the pair of boot support members, and is cantilevered downwardly into the locked position. A release lever is arranged at the front of the base, readily accessible to the skier and includes a member that releases the pair of boot support members from the locked position to the boot receiving or boot released position upon activation of the release lever.

In accordance with other features of the present invention there are the following aspects. The boot is interlocked from both top and bottom. A base has a pressure plate on a front top surface that firmly engages an underside of the boot. The pressure plate is slightly elevated above the rest of the top surface of the base and includes securing pins engageable in holes in the boot for retaining the boot in place. A ridge may also be associated with the pins or substituted for the pins. A cross bar is disposed between the pair of boot support members for engaging the front top of the boot and a pair of stop posts are associated respectively with the pair of support members. The member that releases the pair of support members includes a latch pin that extends through the base retained at its front end at the release lever and has a back end that engages and locks the pair of support members. A cross piece preferably extends between the lateral support members for engagement with the back end of the latch pin, the latch pin being tapered at its back end so as to displace when the lateral support members move downwardly yet lock with the cross piece when fully engaged. A spring is for biasing the latch pin toward a backward position, the base having a front to back passage for receiving the latch pin. The base comprises an outer metal shell and an inner plastic core that has the passage therein. The release lever may be supported from the base by means of a pivot pin, the release lever held by the pivot pin and supported at the front end of the latch pin. Preferably a ski brake is integrated into the base and has wings that extend through the pair of lateral support members. At least one spring is disposed in the base for biasing the brake and for urging the later support members away from the locked position.

In accordance with another aspect of the present invention there is provided a step-in binding for receiving a ski boot preferably for telemark skiing, comprising: a center block constructed and arranged to be secured to the ski; and a pair of boot support members pivotally supported from a front side of the base, and disposed laterally on either side of the base. The lateral side members are preferably tapered inwardly toward the front so as to receive and guide the ski boot as it is to be engaged. The pair of boot support members is biased to a boot receiving position and further has a locked position that is assumed once the boot is received, engages the pair of boot support members, and is cantilevered downwardly into the locked position. A cross bar is disposed transversely between the pair of boot support members for engaging the front top of the boot over the duckbill. A release lever is arranged at the front of the base, readily accessible to the skier and including a member that releases the pair of boot support members from the locked position to the boot receiving position upon activation of the release lever. A ski brake may be integrated into the base, releasable should the boot become disengaged, and constructed and arranged to urge the lateral support members from the locked position to the released position. The center of the cross bar receives the front of the toe box, and the ends of the cross bar extend rearwardly preferably by a distance of 0.75 inches and in a range on the order of 0.25 to 1.75 inches.

In accordance with other features of the present invention there are the following aspects. The base has a pressure plate on a front top surface that firmly engages an underside of the boot, and the pressure plate is slightly elevated above the rest of the top surface of the base and includes securing pins engageable in holes in the boot for retaining the boot in place. The member that releases the pair of support members includes a latch pin that extends through the base retained at its front end at the release lever and having a back end that engages and locks the pair of support members. A cross piece preferably extending between the lateral support members for engagement with the back end of the latch pin, the latch pin being tapered at its back end so as to displace when the lateral support members move downwardly, yet lock with the cross piece when fully engaged, a spring for biasing the latch pin toward a backward position, the base having a front to back passage for receiving the latch pin, and wherein the base comprises an outer metal shell and an inner plastic core that has the passage therein. A cross bar may be disposed between the pair of boot support members for engaging the front top of the boot and a pair of stop posts associated respectively with the pair of support members.

In accordance with still another aspect of the present invention there is provided a step-in binding for receiving a ski boot comprising: a base constructed and arranged to be secured to the ski and a pair of boot support members mounted from a front side of the base, and disposed laterally on either side of the base. The lateral side members are adapted to receive and guide the ski boot as it is received. The pair of boot support members are biased to a boot released position and further have a locked position that is assumed once the boot is received, engages the pair of boot support members, and is cantilevered downwardly into the locked position. A cross bar is disposed transversely between the pair of boot support members for engaging the front top of the boot over the duckbill. A release lever is mounted at the front of the base, readily accessible to the skier and includes a release member that releases the pair of boot support members from the locked position to the boot released position upon activation of the release lever. The lateral support members extend rearwardly from the center of the cross bar preferably by a distance of about 3.25 inches and in a range on the order of 2.0 to 4.5 inches.

In accordance with other features of the present invention there are the following aspects. A ski brake is integrated into the base, and constructed and arranged to urge the lateral support members from the locked position to the released position. The lateral side members are preferably tapered inwardly toward the front so as to receive and guide the ski boot as it is to be engaged. The member that releases the pair of support members includes a latch pin that extends through the base retained at its front end at the release lever and having a back end that engages and locks the pair of support members.

In accordance with still another aspect of the present invention there is provided a step-in binding for receiving a ski boot comprising a base constructed and arranged to be secured to the ski; and a boot support member supported from a front side of said base; The boot support member is biased to a boot receiving position and further has a locked position that is assumed once the boot is received, engages the boot support member, and is cantilevered downwardly into the locked position. A release lever is arranged at the front of the base, readily accessible to the skier and includes a member that releases the boot support member from the locked position to the boot receiving position upon activation of the release lever. A ski brake is integrated into the base, and constructed and arranged to urge the support member from the locked position to the released position.

Another feature relates to the position of the center of the cross bar relative to the toe box. The center of the cross bar receives the front of the toe box of the boot and the ends of the cross bar extend rearwardly by a distance of 0.75 inches in a range on the order of 0.25 to 1.75 inches. Also, the center of the cross bar is spaced rearwardly of the pivot axis of the lateral support members by a dimension of about 1.25 inches and in a range on the order of 0.75 to 2.25 inches.

DETAILED DESCRIPTION

Figure 7:
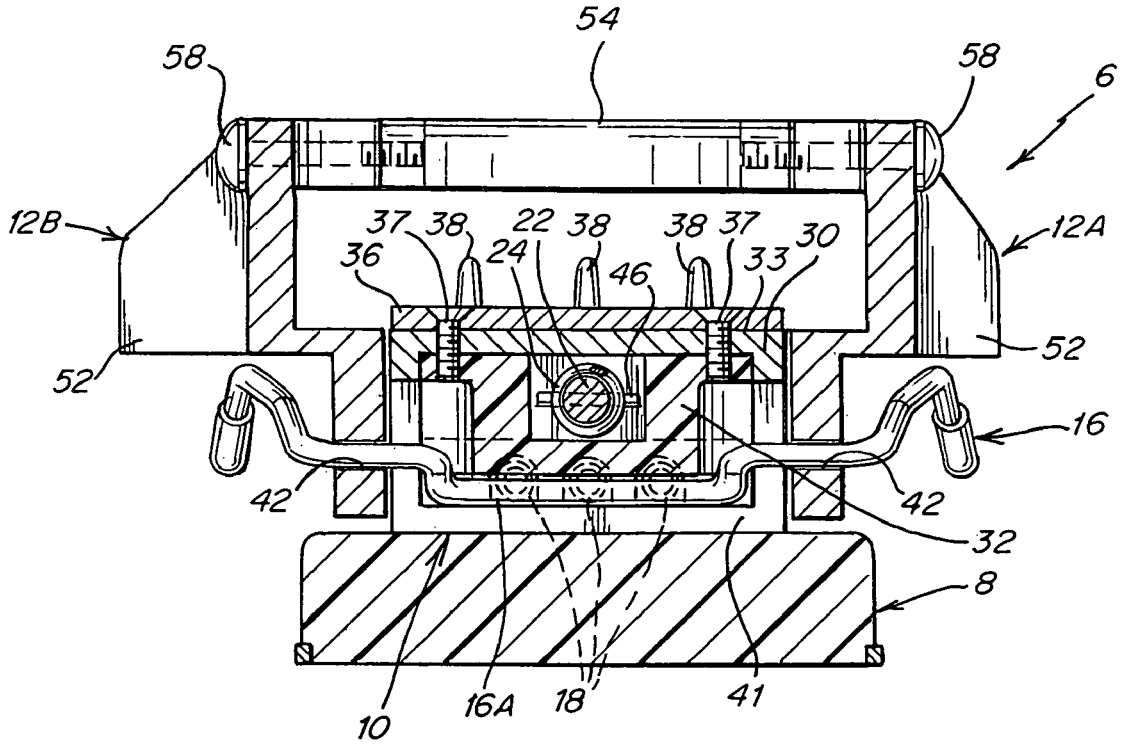
FIG. 7 is a cross-sectional end view of the binding taken along line 7—7 of FIG. 4.
Figure 8:
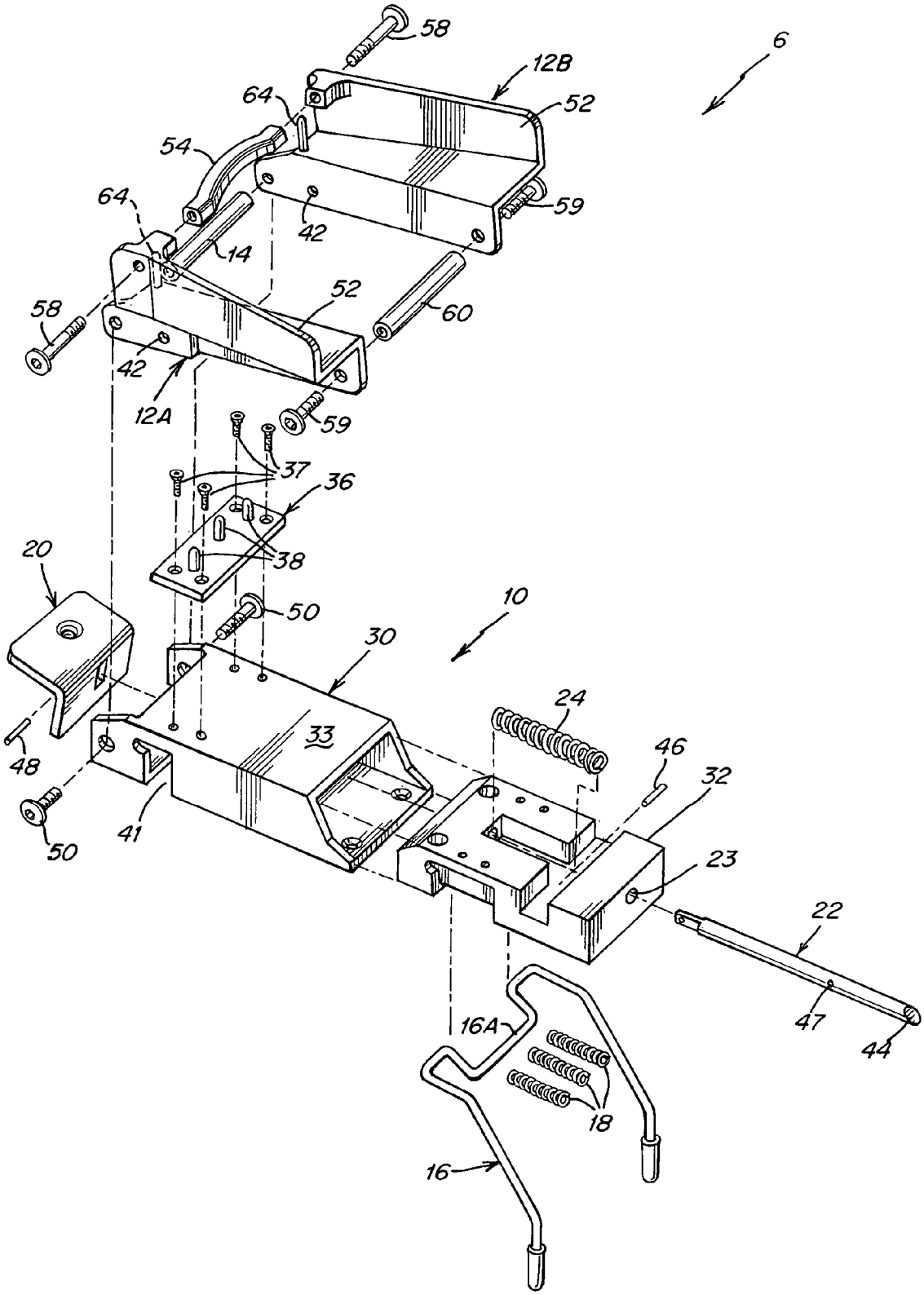
FIG. 8 is an exploded perspective view illustrating the components of the ski binding of the present invention.
Figure 9:
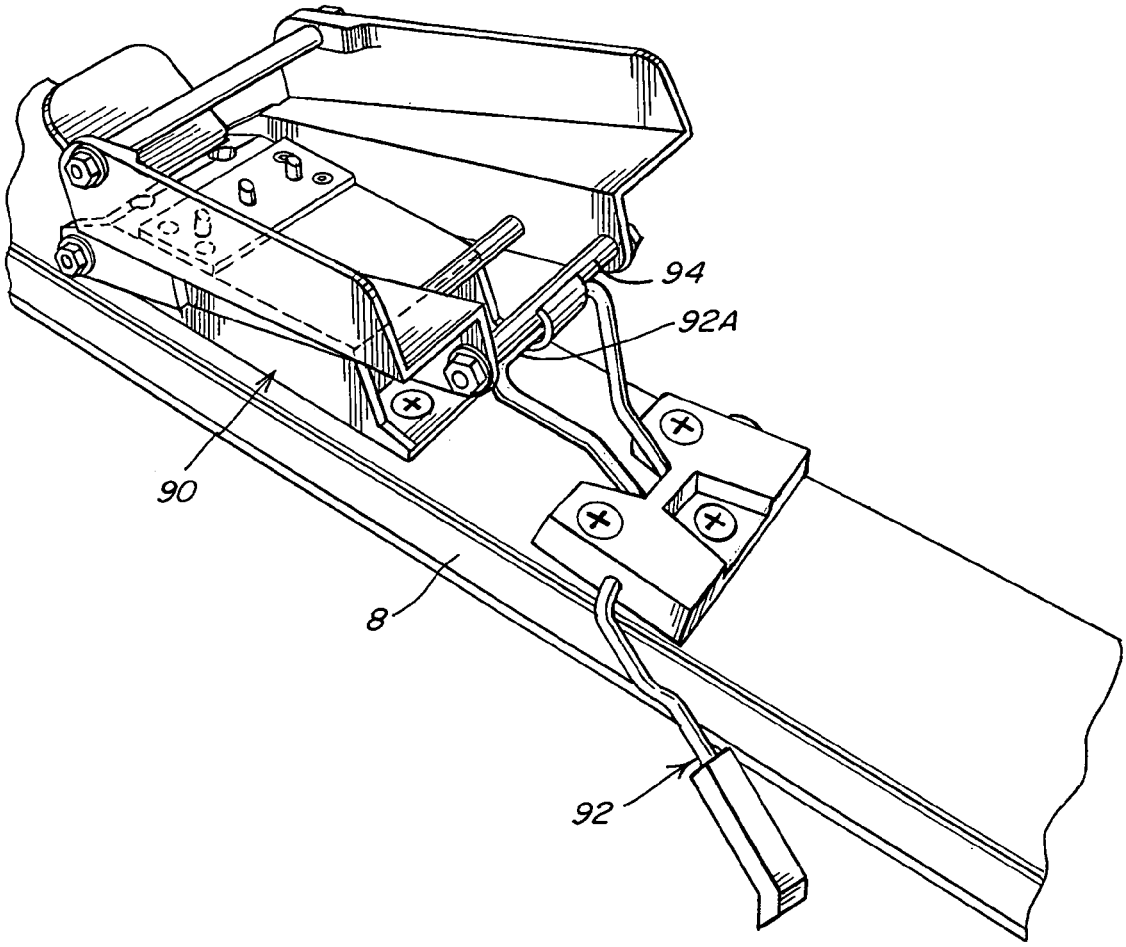
FIG. 9 is a perspective view similar to that illustrated in FIG. 1 but showing an alternate embodiment utilizing a rear mounted ski brake.
Figure 15:
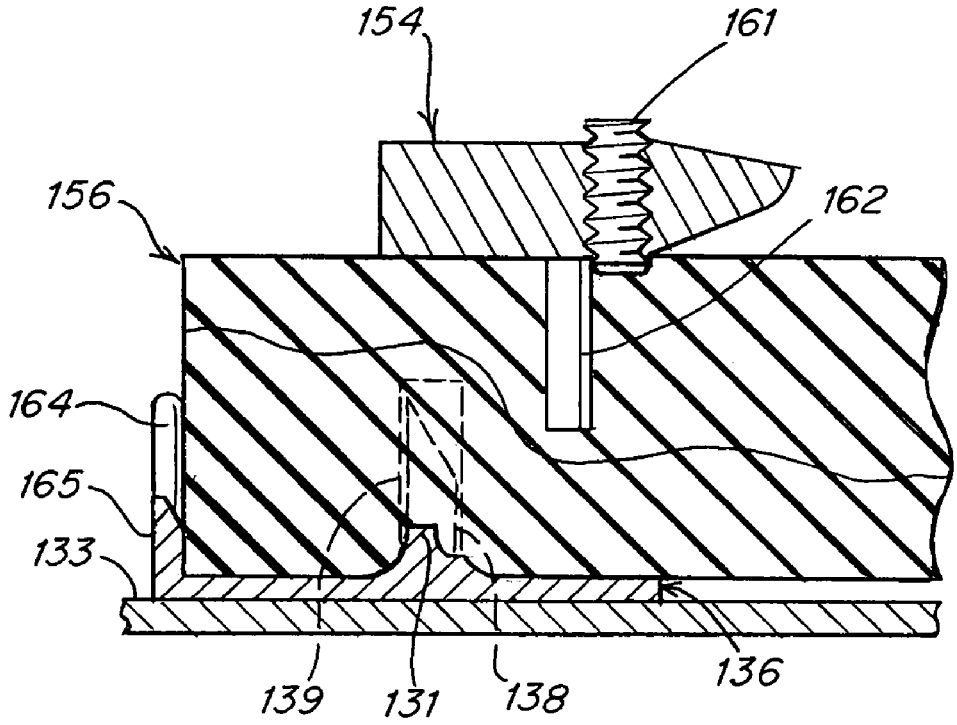
FIG. 15 is an enlarged fragmentary cross-sectional view taken along line 15—15 of FIG. 14.
Figure 16:
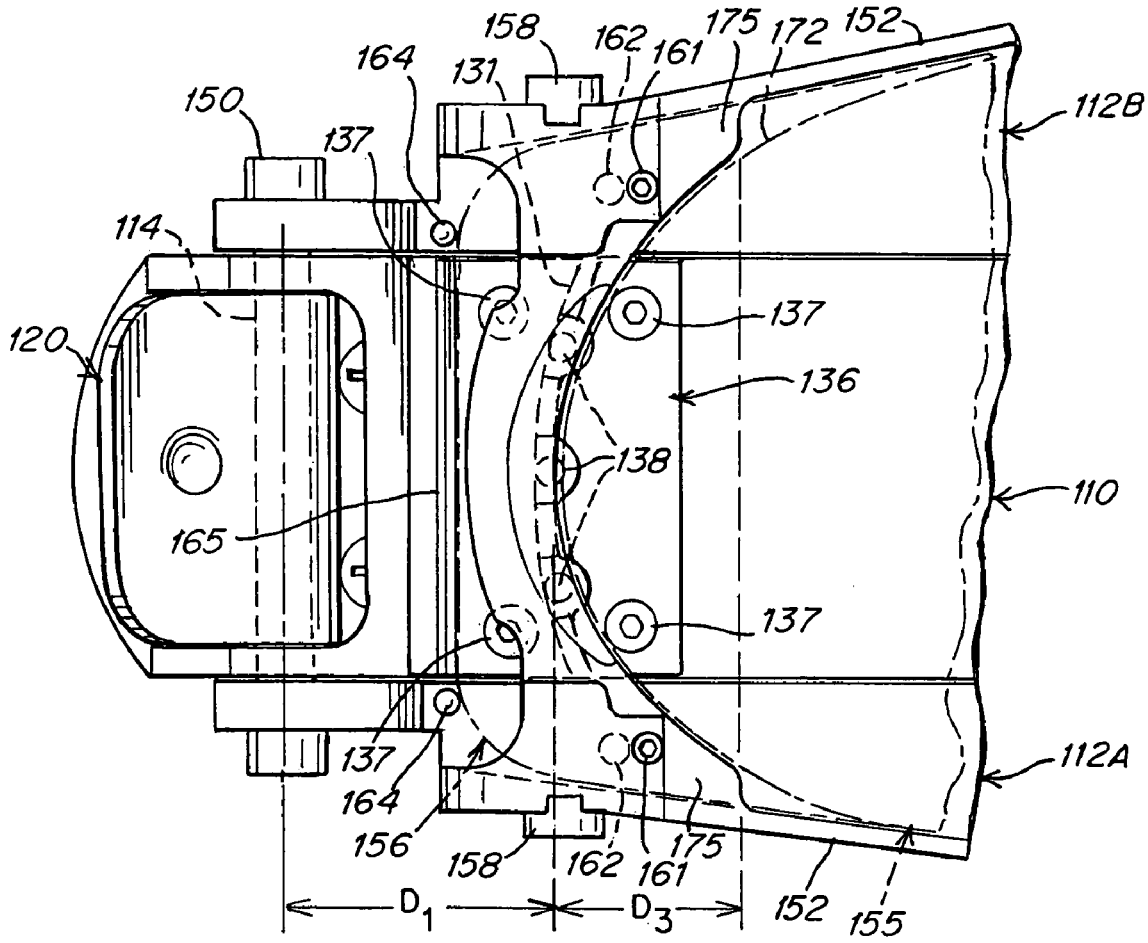
FIG. 16 is a top plan view of the binding as seen along line 16—16 of FIG. 13 with the binding in its latched position.
Figure 17:
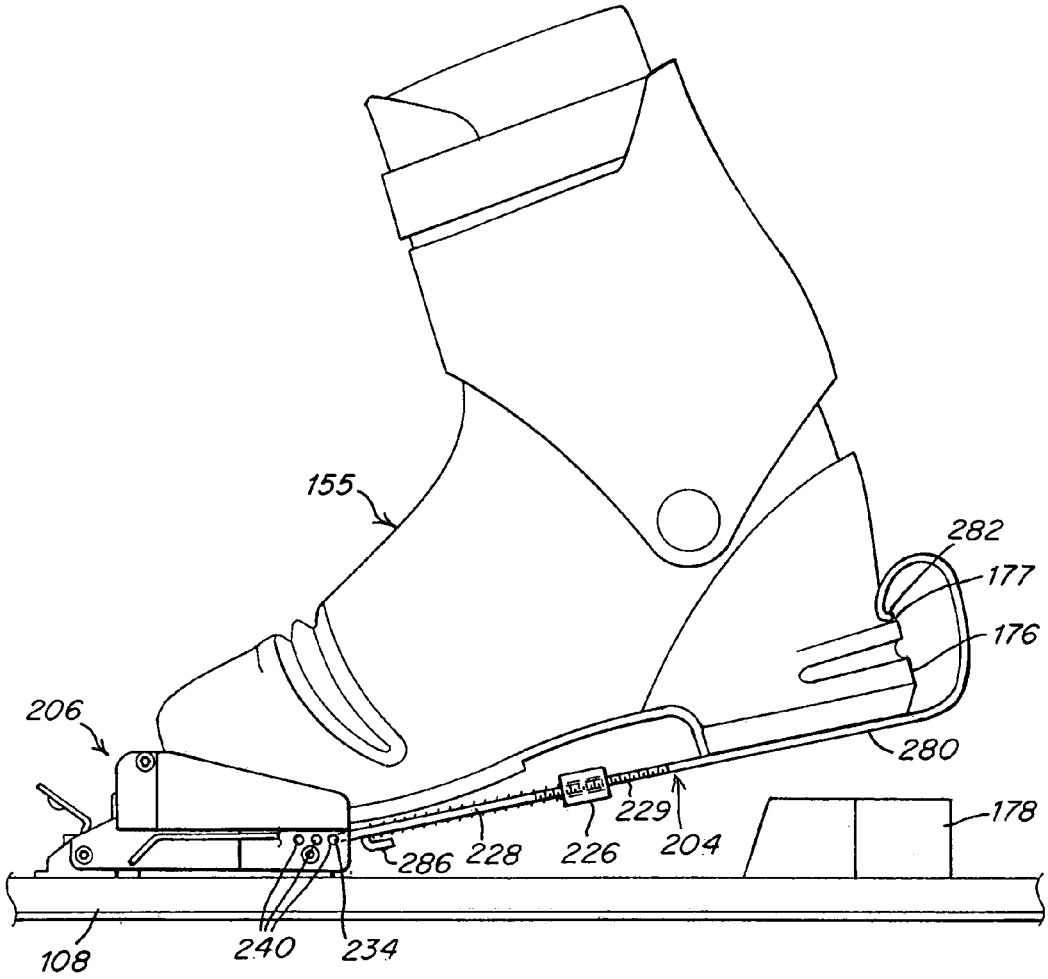
FIG. 17 is a side elevation view of the binding of the present invention used with a heel retention piece.
Figure 18:
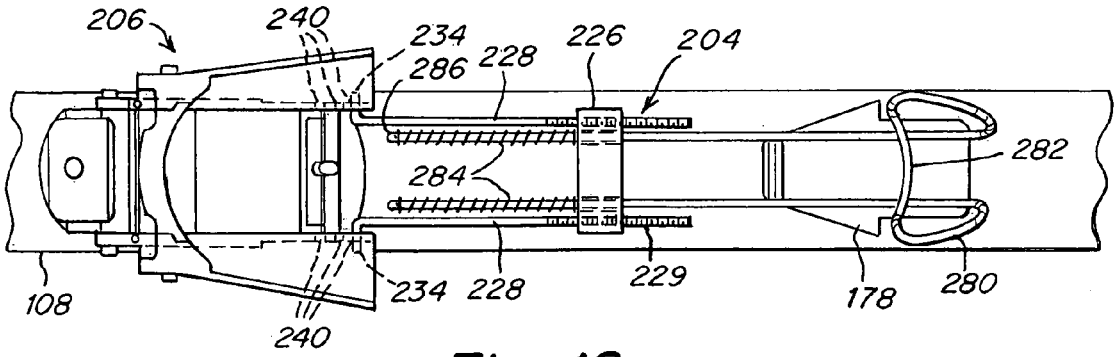
FIG. 18 is a plan view of the binding of FIG. 17.

The step-in binding of the present invention is primarily anticipated for use for Telemark skiing. A first embodiment of the binding is illustrated in FIGS. 1–8. An alternate ski brake construction is illustrated in FIG. 9. FIGS. 10–16 illustrate another embodiment of the invention and FIGS. 17 and 18 illustrate a heel retention piece useable with the binding of the present invention.

In the first embodiment described herein the binding 6 has a cantilever hinge or pivot arrangement that securely fastens the toe of the ski boot to the ski 8. The binding of the present invention is constructed in a very simple manner with an effective mechanism for securing a Telemark boot to the ski, in a step-in manner. With the arrangement of the present invention a skier, in a standing position, inserts the toe of the ski boot under a cross-bar and steps down on the binding mechanism thus attaching the boot to the binding in a step-in fashion. The boot is released from the binding by pressing a release lever or toggle in the front of the binding using, for example, a ski pole. The binding has a simple and yet sturdy and effective design. A ski brake is integrated into the binding thus alleviating the need for ski runaway straps.

Now, with reference to the embodiment of the invention illustrated in FIGS. 1–8, the ski binding 6 is comprised of a center base or block 10 and a pair of boot support members 12A and 12B. The pair of boot support members is disposed laterally on either side of the base 10. These support members 12A and 12B are pivotally supported from the base at a front of the base by means of the pivot pin 14. A ski brake 16 is integrated into the base 10. The ski brake 16 not only functions as a brake for a runaway ski, but also springs 18 associated therewith provide a biasing force for assisting and urging the binding from its locked position to its released position. The release of the binding is facilitated by the use of the release lever 20. The release lever 20 operates the latch pin 22 which is biased by means of the latch pin spring 24.

Figure 1:
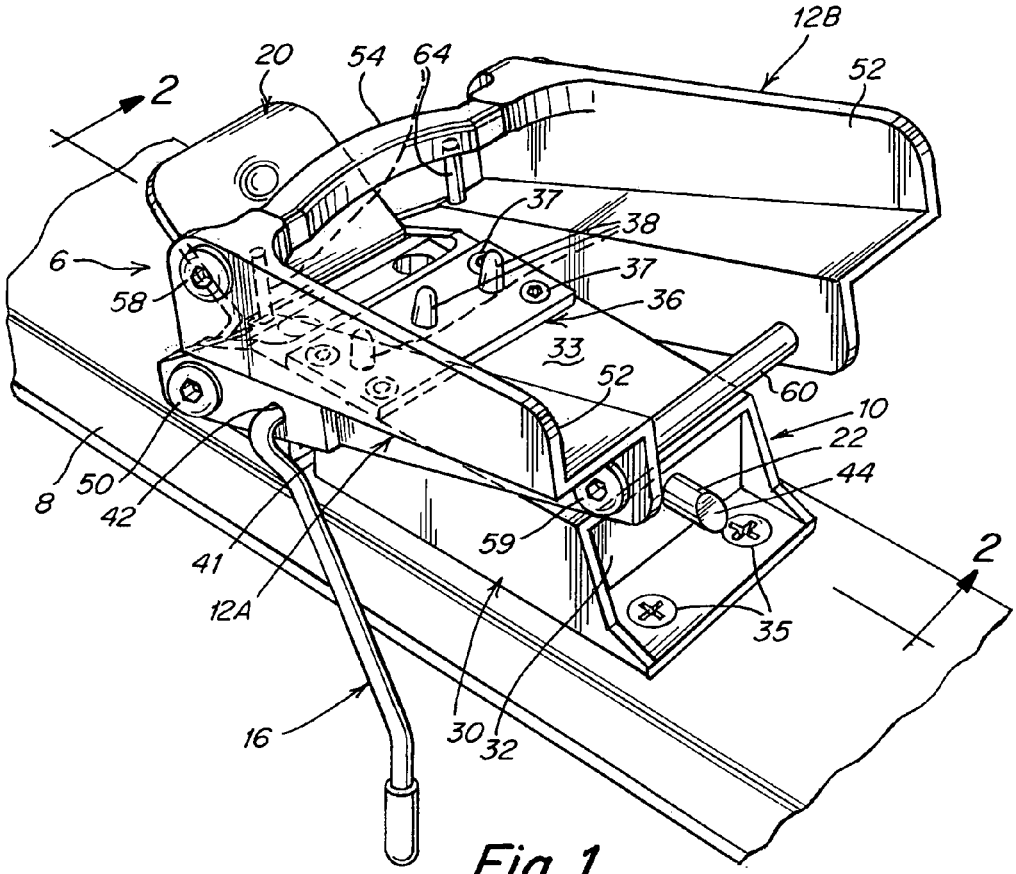
FIG. 1 is a perspective view of one embodiment of the binding of the present invention illustrated in the open position and with the ski brake extended.
Figure 2:
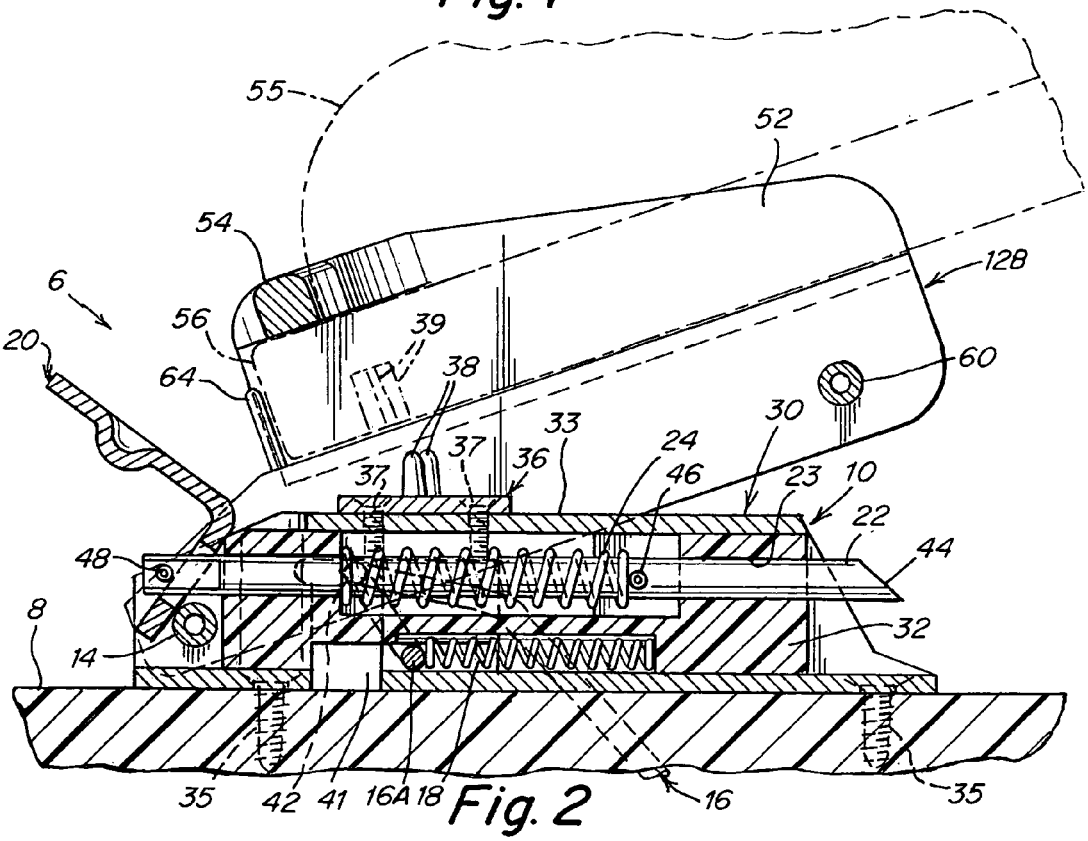
FIG. 2 is a cross-sectional side view taken along line 2—2 of FIG. 1.

The base 10 is comprised of a main channel member 30 having a passage for receiving the plastic block 32. The channel member 30 at its base wall has pairs of front and rear holes for receiving securing screws 35, such as illustrated in FIGS. 1 and 2 and for the purpose of securing the binding to the ski. The passage in the channel member 30 is dimensioned so as to snugly receive the plastic block 32. Means may be provided for holding the block 32 within the passage in the channel member 30. Such means may include screws 37 which also secure the pressure plate 36 to the channel member 30 as illustrated in FIG. 7. Other means may include an adhesive, or one can rely simply upon the close fit between the block and the channel member.

A pressure plate 36 is secured to the top surface at the front of the channel member 30. The pressure plate 36 supports three boot alignment pins 38. FIG. 2 illustrates these alignment pins 38 in the corresponding holes 39 in the sole of the ski boot. It is noted that the pressure plate 36 is elevated above the top surface 33 of the channel member 30. This assures that there is a good pressured fit of the boot to the pressure plate 36.

The base 10 supports the ski brake 16 as well as the binding release mechanism. The center loop 16A of the ski brake 16 is adapted for support within a lower slot in the plastic block 32. In the assembly of the mechanism, the ski brake 16 is engaged with the block through the channel member passage 41, as illustrated in FIG. 8. Opposite sides of the ski brake 16 also extend through respective holes 42 in the support members 12A and 12B. This inter-engagement between the ski brake 16 and the lateral support members 12A and 12B is instrumental in providing the releasing force for release of the binding from its locked position to its released position as illustrated in, for example, FIG. 1. Springs 18 disposed within the block 32 urge the ski brake 16 to the position illustrated in FIGS. 1 and 2, in other words its downward position. When the binding is moved to its locked position then the ski brake 16 rotates upwardly such as to the position illustrated in FIG. 4 with the brake urging against the springs 18. Note in FIG. 4 the more compressed state of the springs 18.

Also supported through the block 32 is the latch pin 22. Block 32 has a front to back passage 23 for receiving the latch pin 22. The rear end of the latch pin 22 is tapered as illustrated at 44. A pin 46 is used, passing though the latch pin 22 at passage 47 so as to secure in position one end of the spring 24. The very front end of the latch pin 22 is secured on the front side of the release lever 20 by means of a further pin 48 also passing through a hole at the front end of latch pin 22.

As indicated previously, the lateral support members 12A and 12B are pivotally supported from the base 10 by means of the pivot pin 14. The rear face of the release lever 20 is urged against pin 14. The pin 14 also functions as a spacer between the support members 12A and 12B, and assures that there is correct spacing between the support members and the pin 14. The pin 14 provides the main pivot for the lateral support members 12A and 12B and is attached to them by means of screws 50, as depicted in FIG. 8.

Figure 5:
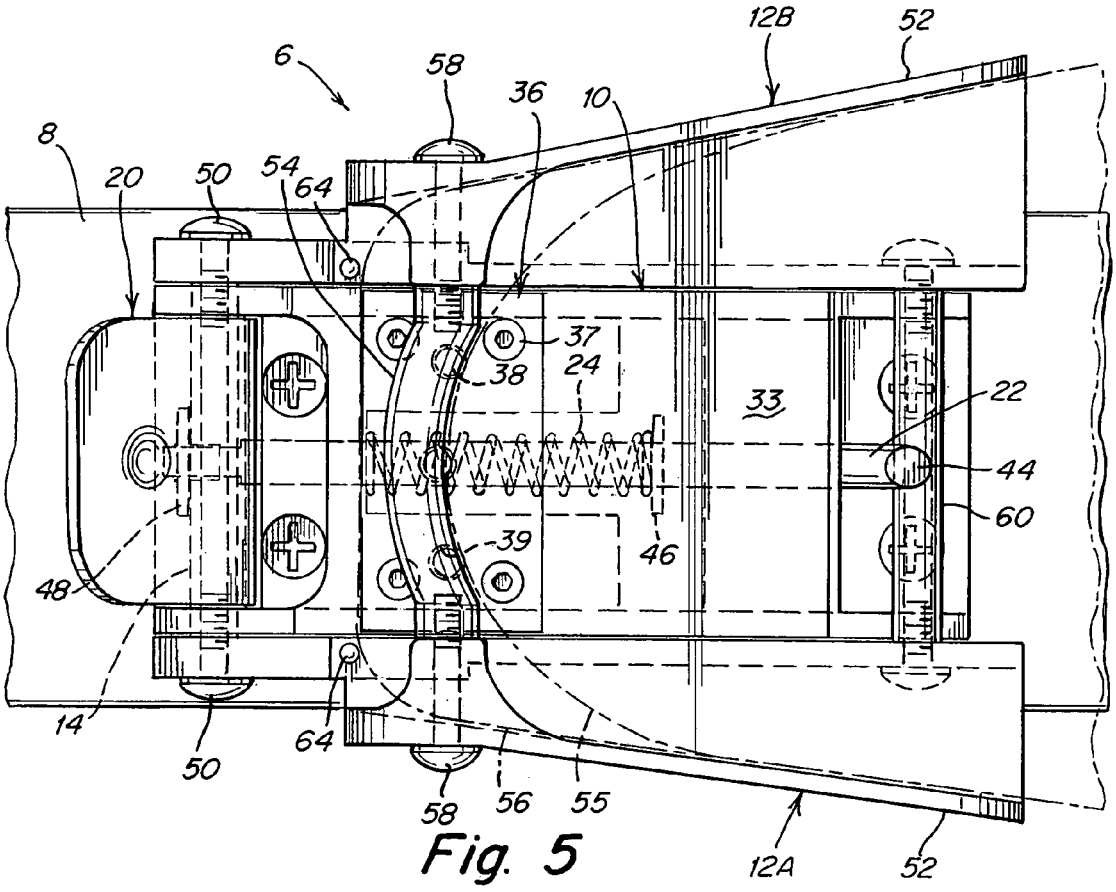
FIG. 5 is a top plan view of the binding as seen along line 5—5 of FIG. 4 with the binding in its latched position.
Figure 6:
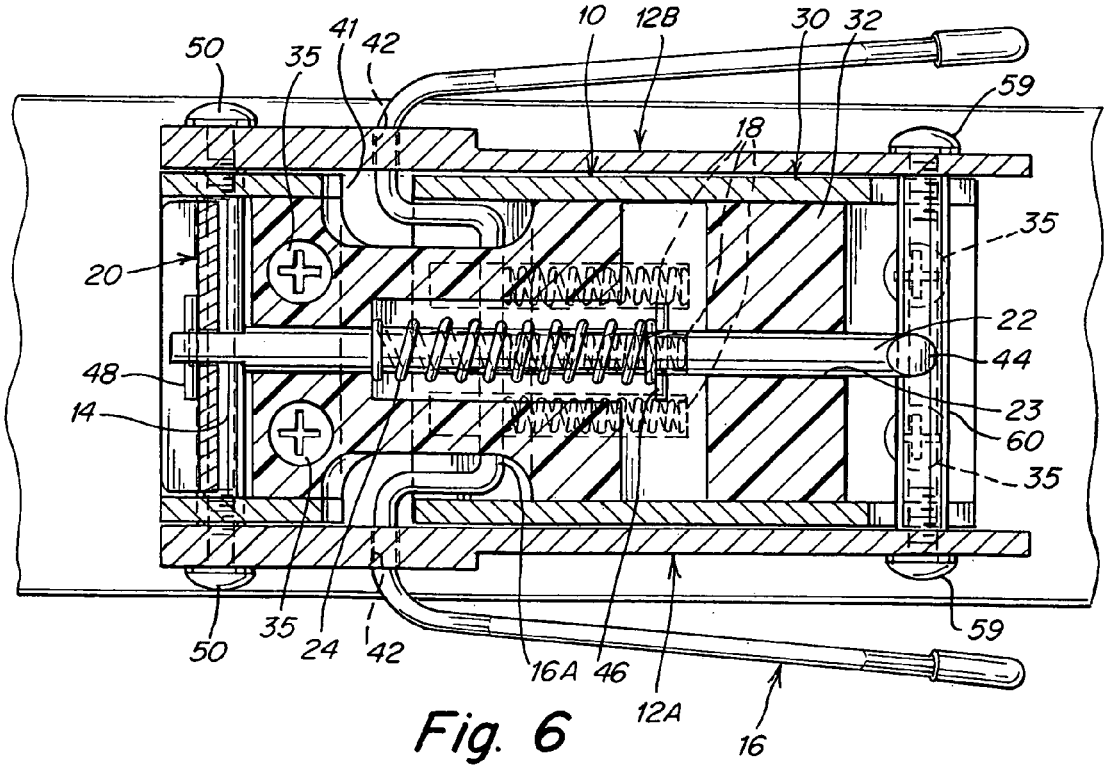
FIG. 6 is a cross-sectional plan view of the binding taken along line 6—6 of FIG. 4.

The lateral support members 12A and 12B each have tapered sidewalls 52 that are adapted to guide the boot as it is inserted, such as the boot 55 illustrated in FIG. 2. Also refer to FIG. 5 showing the convergence of the sidewalls 52. The boot is also engaged under the crossbar 54. The crossbar 54 preferably has a forward curvature so as to properly match the curved front of the ski boot. FIG. 2 illustrates the sole 56 of the ski boot being engaged under the crossbar 54. The crossbar 54 may be supported by screws 58, as illustrated in FIGS. 7 and 8. At the rear of the support members there is also provided another set of screws 59 that supports a spacer bar 60 extending between the support members. The spacers 14, 54 and 60 control the distance between the lateral support members, particularly as it relates to the side-to-side dimensions of the aluminum channel member 30. FIGS. 5 and 6 illustrate this corresponding spacing which is relatively close and yet provides free rotation therebetween. The lateral support members also support at their respective front sides, each a stop pin 64. The combination of these stop pins and the laterally directed walls 52 properly position the ski boot so that when the boot is moved to its locked position the boot is in proper alignment with the pins 38.

FIGS. 1 and 2 illustrate the ski binding of the present invention in its released position. In that position the lateral support members 12A and 12B are pivoted to their most upward position and the ski brake 16 is in its most downward position. As indicated previously, the springs 18 bias the spring brake to this downward position. In this position the release lever is also shown in its rest position. In FIG. 2 the boot has been inserted under the crossbar 54 and the skier is in readiness for engagement with the step-in binding.

Figure 3:
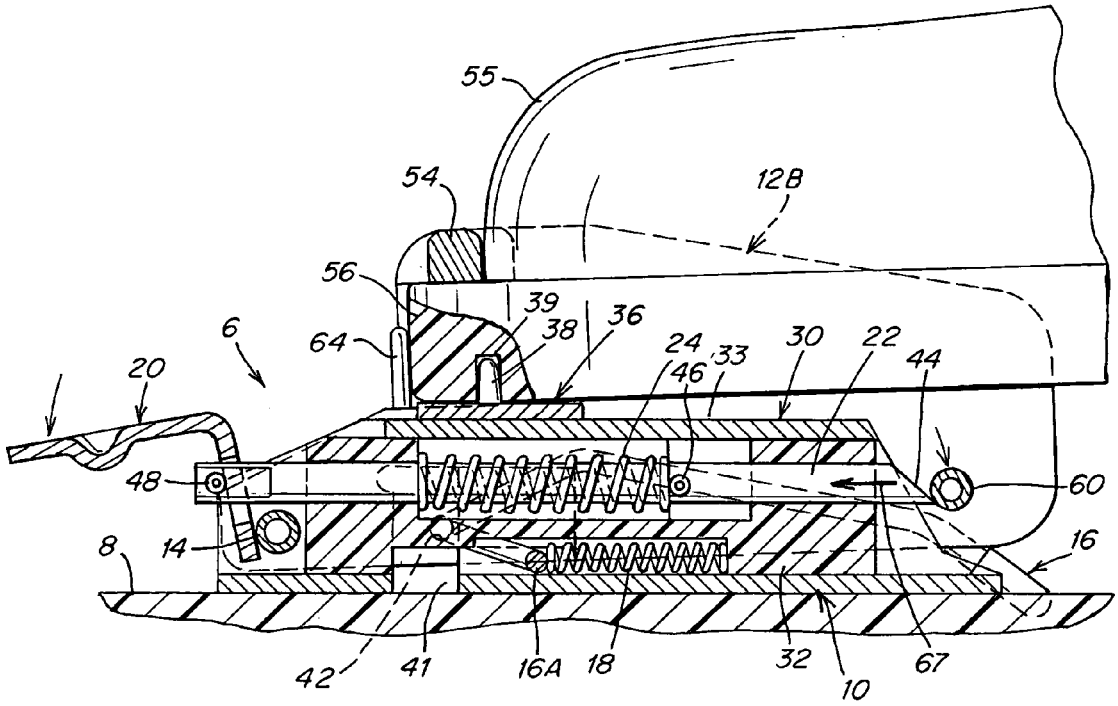
FIG. 3 is a cross -sectional side view similar to that illustrated in FIG. 2 but illustrating a boot engaged in the binding and with the binding being almost fully engaged or latched.

The cross-sectional view of FIG. 3 illustrates the ski boot being almost fully engaged by cantilevering the lateral support members toward their downward position by means of a downward pressure on the ski boot by the skier. In this view it is noted that the ski brake 16 has now moved to a more upward position against the bias of springs 18. The spacer bar 60 is now being urged against the tapered end 44 of the latch pin 22. However, in FIG. 3 the binding is not yet in its fully latched position as the spacer bar 60 is still riding upon the tapered surface 44. The ramping effect of the bar 60 against the tapered end 44 of the latch pin 22 causes the latch pin 22 to move in the direction of arrow 67. It is also noted in FIG. 3 that the release lever 20 has been moved toward a more downward position. Alternatively, when the boot is to be released from engagement with the binding, pushing down on the lever 20 with a ski pole or other means, causes a downward movement of the lever, which, in turn, causes the latch pin to move in the direction of arrow 67.

Figure 4:
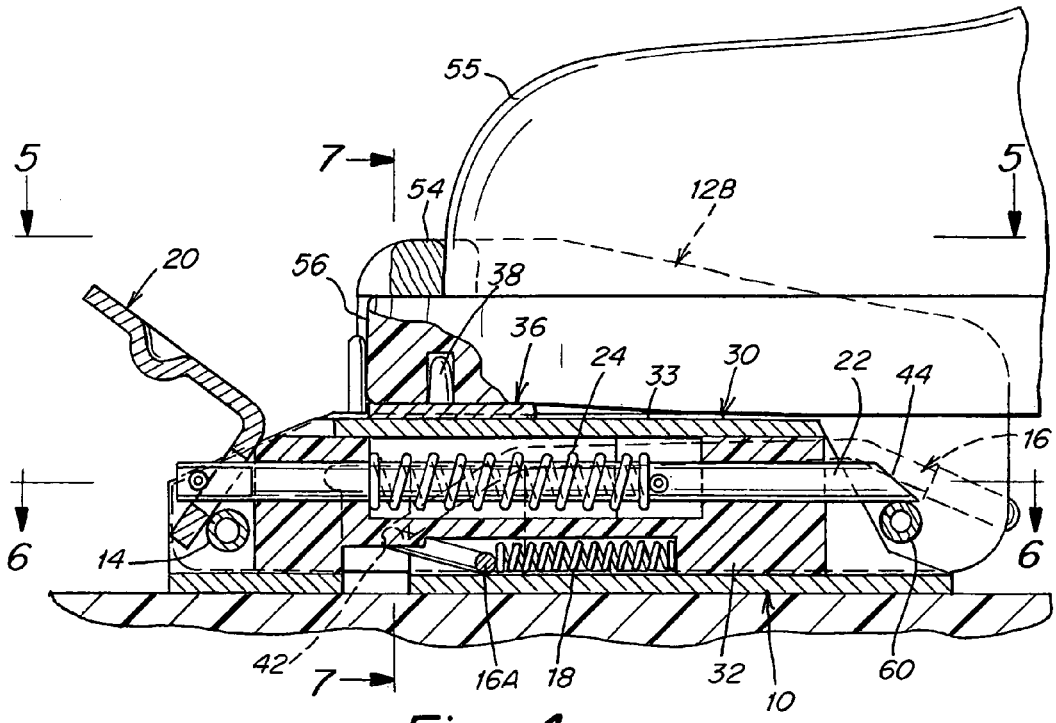
FIG. 4 is a cross-sectional view similar to that illustrated in FIGS. 2 and 3 but illustrating the binding now in a fully latched position.

FIG. 4 illustrates the binding now having been moved to its fully latched position. It is noted that in this position the spacer bar 60 has now moved under the latch pin 22. This action secures the binding in this closed or locked position. In this position it is also noted in FIG. 4 that the spring brake is in its full upward position and that the release lever has assumed its original position because the latch pin has now moved in the opposite direction indicated by arrow 69. The pin 22 is urged in this direction by means of the spring 24.

Reference is now made to FIG. 9 for an alternate embodiment of the invention. This embodiment of the invention also employs a step-in binding. The binding itself 90 is substantially identical to the binding 6 illustrated in FIGS. 1–8 with the exception that the binding illustrated in FIG. 9 does not include the ski brake integrated into the binding. Instead, there is a separate ski brake 92 illustrated in FIG. 9. To accommodate this separate ski brake 92, there is provided a connection of the ski brake at tubular member 94. This ski brake 92, like the ski brake 16 shown in FIGS. 1–8, biases the binding to a released position such as illustrated in FIG. 9. When the skier engages the binding and moves the lateral support members downwardly to a locked position, the ski brake center loop 92A may also move downwardly against the bias of a spring means associated with the ski brake 92 rotating the ski brake 92 upwards.

It can be readily seen from the foregoing description, that the step-in binding of this invention is a relatively simple construction and, in the preferred embodiment, incorporates the ski brake into the binding. The ski brake actually functions both as a brake and as a means for assisting in releasing the binding by means of the bias of associated ski brake springs.

Another feature of the present invention is the relative flatness of the entire mechanism, particularly at the top surface 33 and at the surfaces that the boot rest upon on the lateral support members. By making these surfaces flat, there is far less of a likelihood of snow and ice buildup between the ski boot and the binding surfaces.

Another feature of the present invention is the use of a separate pressure plate elevated slightly above the surface 33 that enables a firm pressure contact with the boot, between the pressure plate 36 and the crossbar 54.

Still another feature of the present invention is the preferred front positioning of the release lever. Many times release levers are disposed on the back of the binding and this makes it quite difficult to have access thereto. In accordance with the present invention the release lever is readily accessible at the front of the binding and preferably has an indentation therein to receive, for example, the end of a ski pole.

Another feature of the present invention relates to the simplified construction, such as the use of three crossbars that are used to unify the lateral support members. The front bar forms the hinge mechanism, the bar across the top of the boot holds the boot in place, and the rear bar locks the lateral member down. This locking down occurs between the spacer 60 and the pin 22. Also, it is noted that the cross bars (spacers) abut to the inner surface of the lateral members thus maintaining the width necessary to receive the center block. These pins that support the bars or spacers are held in place with a screw through the lateral members and threaded into them.

Another embodiment of the present invention is shown in FIGS. 10–14 in which further aspects of the ski binding are illustrated. Now, with reference to the embodiment of the invention illustrated in FIGS. 10–14, the ski binding 106 is comprised of a center base or block 110 and a pair of boot support members 112A and 112B. The pair of boot support members is disposed laterally on either side of the base 110. These support members 112A and 112B are pivotally supported from the base at a front of the base by means of the pivot pin 114. A ski brake 116 is integrated into the base 110. The ski brake 116 not only functions as a brake for a runaway ski, but also springs 118 associated therewith provide a biasing force for assisting and urging the binding from its locked position to its released position. The release of the binding is facilitated by the use of the release lever 120. The release lever 120 operates the latch pin 122 which is biased by means of the latch pin spring 124.

Figure 10:
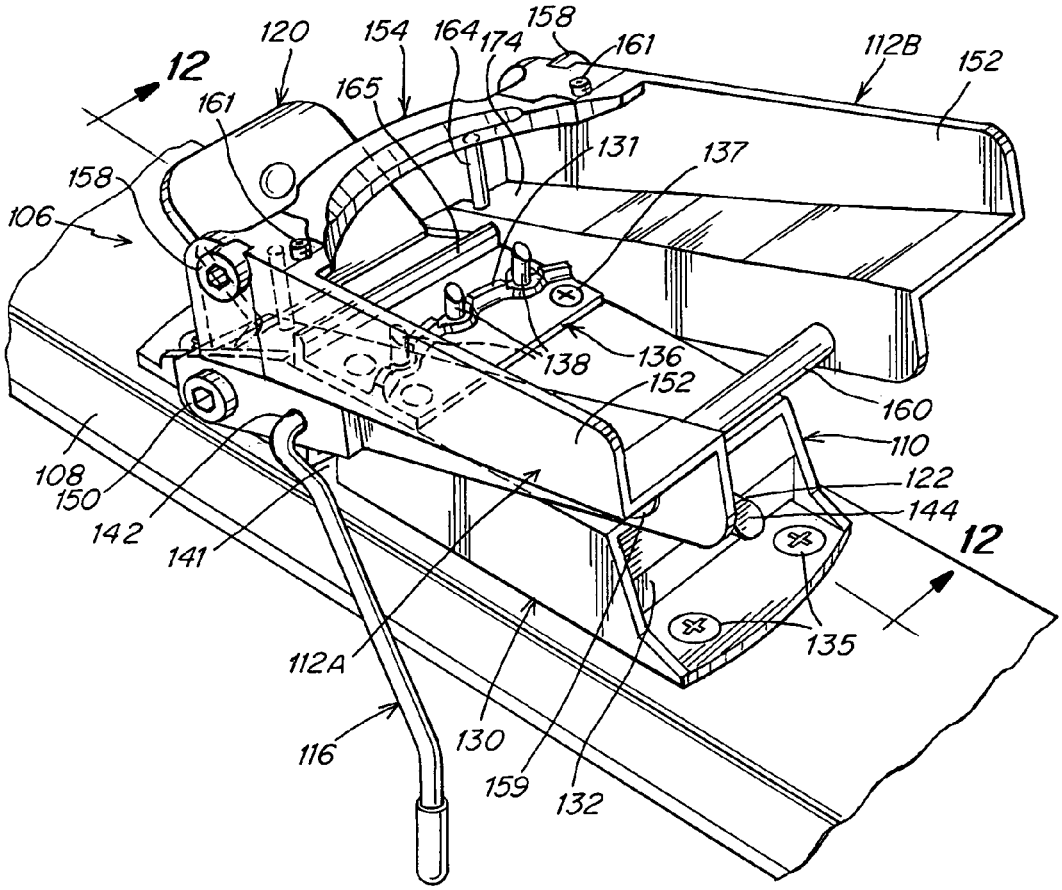
FIG. 10 is a perspective view of another embodiment of the binding of the present invention illustrated in the open position and with the ski brake extended.

The base 110 is comprised of a main channel member 130 having a passage for receiving the plastic block 132. The channel member 130 at its base wall has pairs of front and rear holes for receiving securing screws 135, such as illustrated in FIG. 10 and for the purpose of securing the binding to the ski 108. The passage in the channel member 130 is dimensioned so as to snugly receive the plastic block 132. Means may be provided for holding the block 132 within the passage in the channel member 130. Such means may include screws 137 which also secure the pressure plate 136 to the channel member 130 as illustrated in FIG. 10. Other means may include an adhesive, or one can rely simply upon the close fit between the block and the channel member.

Figure 13:
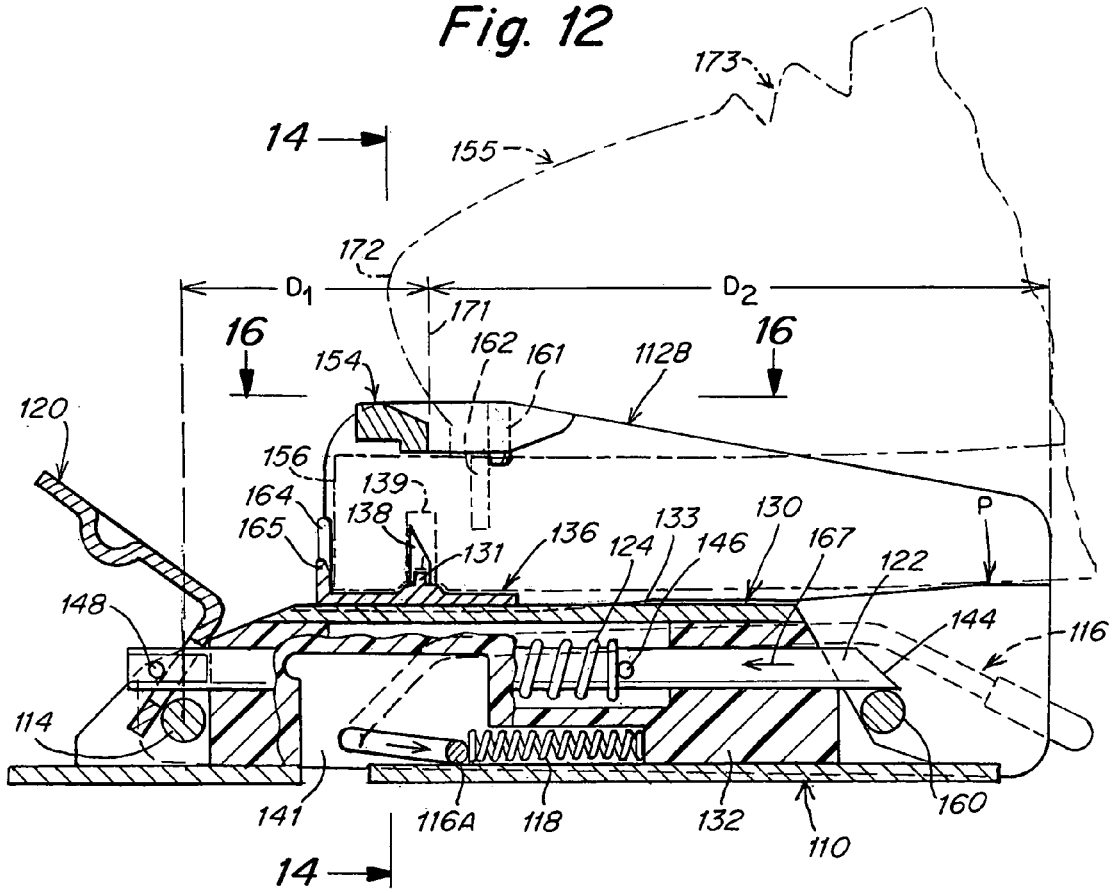
FIG. 13 is a cross-sectional side view similar to that illustrated in FIG. 12 but illustrating a boot engaged in the binding and with the binding being fully engaged or latched.

The pressure plate 136 is secured to the top surface at the front of the channel member 130. The pressure plate 136 supports three boot alignment pins 138. FIG. 13 illustrates these alignment pins 138 in the corresponding holes 139 in the sole of the ski boot when the boot is fully engaged. It is noted that the pressure plate 136 is elevated above the top surface 133 of the channel member 130. This assures that there is a good pressured fit of the boot to the pressure plate 136.

Figure 12:
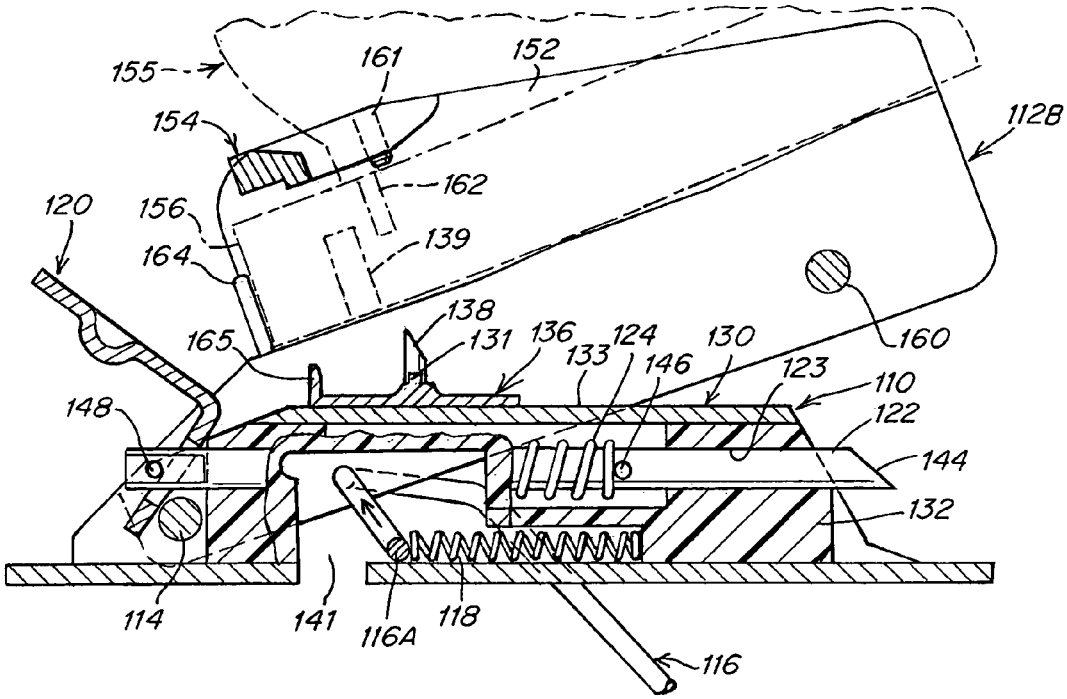
FIG. 12 is a cross-sectional side view taken along line 12—12 of FIG. 10.

The base 110 supports the ski brake 116 as well as the binding release mechanism. The center loop 116A of the ski brake 116 is adapted for support within a lower slot in the plastic block 132. In the assembly of the mechanism, the ski brake 116 is engaged with the block through the channel member passage 141, as illustrated in FIGS. 10, 12 and 13. Opposite sides of the ski brake 116 also extend through respective holes 142 in the support members 112A and 112B. This inter-engagement between the ski brake 116 and the lateral support members 112A and 112B is instrumental in providing the releasing force for release of the binding from its locked position to its released position as illustrated in, for example, FIG. 13. Springs 118 disposed within the block 132 urge the ski brake 116 to the position illustrated in FIGS. 10 and 12, in other words its downward position. When the binding is moved to its locked position then the ski brake 116 rotates upwardly such as to the position illustrated in FIG. 13 with the brake urging against the springs 118. Note in FIG. 13 the more compressed state of the springs 118.

Also supported through the block 132 is the latch pin 122. Block 132 has a front to back passage 123 for receiving the latch pin 122. The rear end of the latch pin 122 is tapered as illustrated at 144. A pin 146 is used, passing though a hole in the latch pin 122 so as to secure in position one end of the spring 124. The very front end of the latch pin 122 is secured on the front side of the release lever 120 by means of a further pin 148 also passing through a hole at the front end of latch pin 122.

As indicated previously, the lateral support members 112A and 112B are pivotally supported from the base 110 by means of the pivot pin 114. The rear face of the release lever 120 is urged against pin 114. The pin 114 also functions as a spacer between the support members 112A and 112B, and assures that there is correct spacing between the support members and the pin 114. The pin 114 provides the main pivot for the lateral support members 112A and 112B and is attached to them by means of screws 150, as depicted in FIG. 10.

Figure 14:
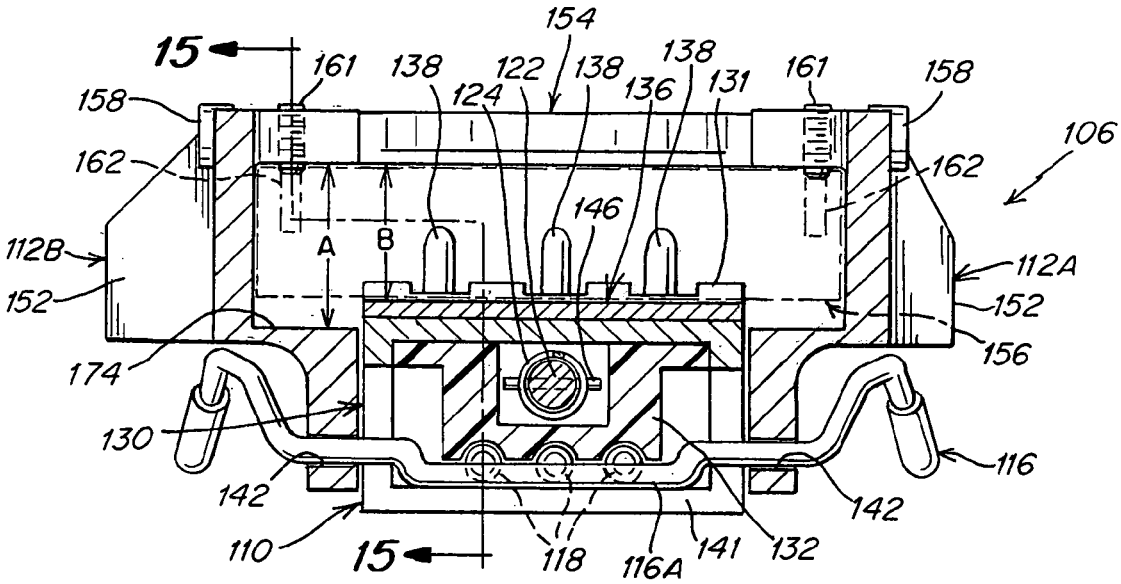
FIG. 14 is a cross-sectional end view of the binding taken along line 14—14 of FIG. 13.

The lateral support members 112A and 112B each have tapered sidewalls 152 that are adapted to guide the boot as it is inserted, such as the boot 155 illustrated in FIGS. 12 and 13. Also refer to FIG. 16 showing the convergence of the sidewalls 152. The boot is also engaged under the crossbar 154. The crossbar 154 preferably has a forward curvature so as to properly match the curved front of the ski boot. FIG. 12 illustrates the sole 156 of the ski boot being engaged under the crossbar 154. The crossbar 154 may be supported by screws 158, as illustrated in FIGS. 14 and 16. At the rear of the support members there is also provided another set of screws 159 that supports a spacer bar 160 extending between the support members. The spacers 114, 154 and 160 control the distance between the lateral support members, particularly as it relates to the side-to-side dimensions of the aluminum channel member 130. FIG. 10 illustrates this corresponding spacing which is relatively close and yet provides free rotation therebetween. The lateral support members also support at their respective front sides, each a stop pin 164. The combination of these stop pins and the laterally directed walls 152 properly position the ski boot so that when the boot is moved to its locked position the boot is in proper alignment with the pins 138.

FIGS. 10 and 12 illustrate the ski binding of the present invention in its released position. In that position the lateral support members 112A and 112B are pivoted to their most upward position and the ski brake 116 is in its most downward position. As indicated previously, the springs 118 bias the spring brake to this downward position. In this position the release lever is also shown in its rest position. In FIG. 12 the boot has been inserted under the crossbar 154 and the skier is in readiness for engagement with the step-in binding.

The cross-sectional view of FIGS. 12 and 13 illustrates the action of the binding when applying downward pressure P on the rearward extension of the lateral members by the skier's boot. It is important to note the specific geometry and unified structure of the lateral members and the over riding cross bar, so that downward pressure at P directly translates into downward pressure under the crossbar 154. This downward force under the crossbar 154 engages the sole of the ski boot with sufficient force to drive the pins 138, a raised ridge or lip 131 shown in FIGS. 10, 12 and 14, and the adjustable set screw 161 at each end of the overriding cross bar 154, as illustrated in FIG. 10 or the hooked or ridged member illustrated in FIG. 15A, securely into the sole of the ski boot.

The cross-sectional view of FIG. 13 illustrates the ski boot being fully engaged by cantilevering the lateral support members toward their downward position by means of a downward pressure P on the ski boot by the skier. In this view it is noted that the ski brake 116 has now moved to an upward position against the bias of springs 118. The spacer bar 160 has been urged against the tapered end 144 of the latch pin 122. The ramping effect of the bar 160 against the tapered end 144 of the latch pin 122 causes the latch pin 122 to move in the direction of arrow 167. The release lever 120 has been moved toward a more downward position. Alternatively, when the boot is to be released from engagement with the binding, pushing down on the lever 120 with a ski pole or other means, causes a downward movement of the lever, which, in turn, causes the latch pin to move in the direction of arrow 167.

FIG. 13 illustrates the binding having been moved to its fully latched position. It is noted that in this position the spacer bar 160 has now moved under the latch pin 122. This action secures the binding in this closed or locked position. In this position it is also noted in FIG. 13 that the spring brake is in its full upward position and that the release lever has assumed its original position because the latch pin has now moved in the opposite direction. The pin 122 is urged in this direction by means of the spring 124.

As indicated previously, the ski boot is locked to the binding by, inter alia, the pins 138 engaging in holes 139 in the sole of the ski boot. This interlocking is depicted in FIG. 13. In addition, the pressure plate 136 is preferably provided with a raised ridge or lip 131 shown in FIGS. 10, 12 and 14. This ridge or lip 131 may extend as shown in FIG. 10 from one side to the other of the pressure plate 136, and provides additional interlocking between the ski boot and binding. The bottom of the sole of the boot is sufficiently resilient so that the ridge 131 presses into the resilient sole material. Alternatively, the sole may be provided with a matching groove to receive the ridge or lip 131. Alternatively, the ski boot may lock into the pressure plate with a raised ridge that conforms to the shape of the ski boot without the use of the pins 138.

FIG. 10 illustrates, in addition to the stop pins 164, a stop ridge 165 that is disclosed as formed as part of the pressure plate 136. The ridge 165 is disposed at a right angle to the flat surface of the pressure plate 136, and the very front surface 157 of the boot sole is urged against this ridge 165 when in the seated position such as illustrated in FIG. 13. The combination of the stop pins 164 and ridge 165 properly positions the sole of the ski boot for engagement with the pressure plate 136.

Figure 11:
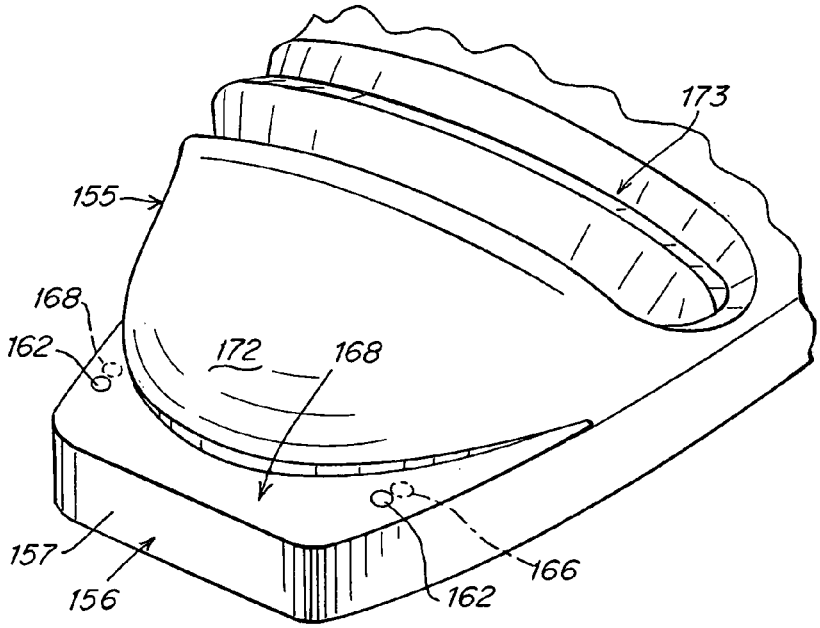
FIG. 11 is a fragmentary perspective view of the toe of the ski boot.

The embodiment illustrated in FIGS. 10–14 also has a further means for securing the ski boot in place. This includes providing an adjustable set screw 161 at each end of the overriding cross bar 154, as illustrated in FIG. 10. Refer also to FIG. 15 showing one of the set screws 161 screwed into the cross bar 154 but extending slightly below the lower surface of the cross bar so as to be engageable with a flat surface or indentation (see 166 in FIG. 11) in the sole of the ski boot. Refer also to FIGS. 11–13. Adjacent to the position of the set screw 161, as illustrated in FIG. 15, is an implanted metal stud 162 that is positioned in the sole of the boot, one on either side of the sole duckbill 168 as shown in the fragmentary perspective view of FIG. 11. Refer also to FIGS. 12 and 13, particularly FIG. 13 where the set screw 161 is urged against the metal stud 162. FIG. 15 also depicts the engaged position where the set screw 161 is engaged against the implanted metal stud 162. This arrangement provides for essential interlocking on both top and bottom surfaces of the boot sole, such as illustrated in FIG. 13.

Figure 14A:
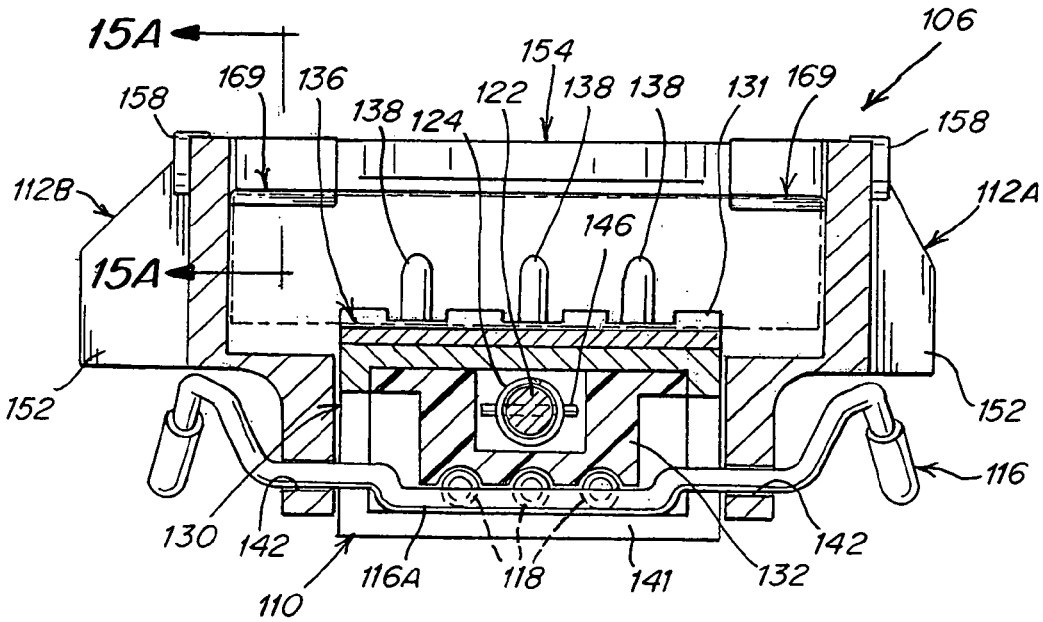
FIG. 14A is a cross-sectional end view similar to the view of FIG. 14 but illustrating an alternative design.
Figure 15A:
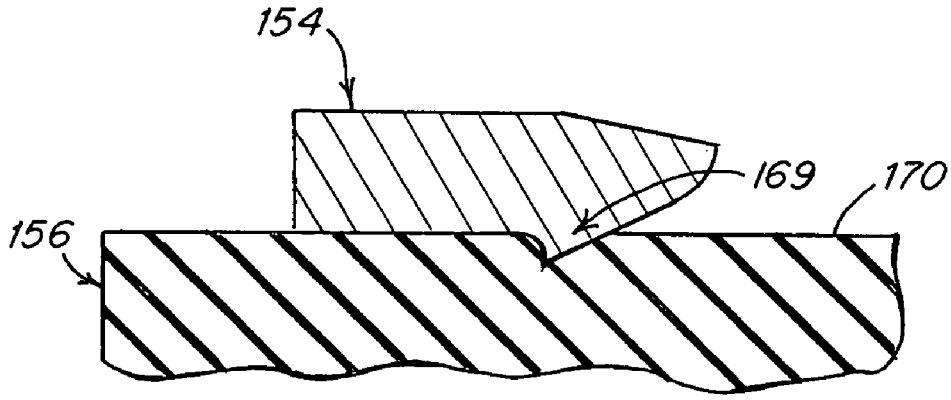
FIG. 15A is fragmentary cross-sectional view of the alternative toe engagement design as taken along line 15A—15A of FIG. 14A.

FIG. 14 shows the embodiment in which there is provided the combination of a set screw and implanted stud. An alternate embodiment of interlocking is illustrated in FIG. 14A where the ends of the cross bar are each provided with a ridge or hooked end 169. A cross-section of the hooked or ridged member is also illustrated in FIG. 15A. This hooked end or ridge is meant to engage with the upper surface 170 of the duckbill portion of the boot sole (similarly to the ridge on the pressure plate from below the boot sole). The surface 170 may be provided with an indentation to receive the additional ridge of material 169 under the cross bar.

It should be noted that the adjustable set screws in the upper crossbar may have other purposes. In addition to engaging the sole of the ski boot the screw can be used to adjust the binding to fit the sole 156 of the ski boot 155 that may vary in thickness.

The embodiment of FIGS. 10–14 is also characterized by important dimensional parameters. Some of these are illustrated in the cross-sectional view of FIG. 13. The dimension $D_1$ represents the length between the pivot at pin 114 and the very front of the toe box 172 as depicted by the line 171 in FIG. 13. The pivot at 114 is thus forward of the cross bar 154 and of the front of the toe box 172. The dimension $D_1$ is preferably about 1.25 inches and may be in a range of 0.75 to 2.25 inches. The dimension $D_2$ represents the length between the front of the toe box (line 171 in FIG. 13) and the end of the lateral support members 112A and 112B. The dimension $D_2$ is preferably at least 2.5 inches, may be about 3.25 inches and may be in a range of 2.0 to 4.5 inches. Also, the dimension measured from the front of the toe box to the bellows 173 may be on the order of 2.5 inches. The dimensional ratio of $D_2$ to $D_1$ is in a range between 2 to 1 and 3 to 1.

Reference is now made to FIG. 14 for an illustration of other dimensional considerations. The dimension $D_3$ represents a length or height between the bottom of the cross bar 154 and the flat surface 174 of either of the lateral support members 112A or 112B. The dimension B represents a length or height between the bottom of the cross bar 154 and the top of the pressure plate 136. The dimension A is slightly greater than the dimension B so as to enable ready initial placement of the boot into the binding and allow clearance for the set screw or ridge that extends from the overriding cross bar.

Reference is now made to FIG. 16 for an illustration of other dimensional considerations. The dimension $D_1$, as indicated before, indicates the distance between the front of the toe box and the pivot at 114. The dimension $D_3$ represents a distance from the front of the toe box to the most rear portion 175 of the overriding cross bar member 154. It is preferred to have the portion 175 as far back as is reasonably possible so as to provide proper grasping force by the cross bar against the boot sole. The dimension $D_3$ may be on the order of the dimension $D_1$, but is usually less than the dimension $D_1$.

The inter-relationship between of the dimensions and ratios, particularly as to the relationship between dimension $D_1$ and either dimension $D_2$ or dimension $D_3$, is important to the action of the binding of the present invention. The length of the dimension $D_2$ is longer than either the dimension $D_3$ or the dimension $D_1$ to provide enough mechanical advantage (momentum arm) to fixedly lock the boot in place. The dimension $D_2$ extends rearwardly as far as practical to provide for the maximum lever force generated by the downward force of the boot when stepping down into the binding. If the dimension $D_2$ is too short, or in other words, under 2.0 inches there is not sufficient lever (force) action. The maximum length of dimension $D_2$ is limited by the fact that the boot sole curves up and no longer contacts the surface of the binding greater than about 4.5 inches back. The dimension $D_2$ is at least twice as long as either the dimension $D_1$ or the dimension $D_3$.

The dimension $D_3$ as relates to the dimension $D_2$ provides the downward force on the duckbill 168 to effectively lock the boot in place. The rearward extension of dimension $D_3$ is important to spread the force on the top of the duckbill over a wider area and causes the boot to flex further back towards the bellows, as well as to provide an additional locking surface against the top of the boot sole. The dimension $D_1$ has some extension forward to provide enough upward rotation of the carriage (lateral support member and cross bar) when the binding is open to clear the raised pin plate 136 and pins 138 when inserting the duckbill into the binding but shorter than the dimension $D_2$ to generate mechanical advantage. As indicted previously, the binding ratio of dimension $D_1$ to dimension $D_2$ should be a minimum of 1:2. The rearward extension of dimension $D_3$ improves retention of the ski boot but is limited in length by the rearward extension of the duckbill and is shorter than dimension $D_2$ to maintain the mechanical advantage generated by the $D_1/D_2$ geometry.

One feature of the present invention relates to the ease with which the boot can be engaged with the binding. In the position illustrated in FIG. 12 with the binding open, the boot can be easily slid by the set screw or ridge 161. This is possible by making the dimension A greater than the dimension B so that the boot readily slides into the lateral support members and under the cross bar. The very front of the support surface 174 for each support member may also be slightly dished out to provide additional clearance for the toe of the boot.

Another feature of the present invention relates to the positive engagement of the boot provided by retaining the boot from both above and below. This is possible with the use of the set screw or ridge 116 engaging the boot from above, and the pins 138 or ridge engaging the boot from below, thus providing a clamp like action on the ski boot.

Still another feature of the present invention relates to the positive camming and clamping aspect of the binding structure. The structure provides a vertical squeezing force generated between the center block (top surface 133 of the channel member 130) and the top cross bar 154 thus locking the duckbill 168 in place when stepping down on the laterally placed support members or wings 112A and 112B. This clamping feature is possible with the combined use of a carriage that is pivoted from a base piece. The carriage is fundamentally comprised of the two lateral support members 112A and 112B, and the overhead cross bar 154. These carriage components can also be made as a unitary one piece structure, can be bent to shape or can be molded in a single piece. The pivot at pin 114 is forward of the cross bar 154 by the dimension $D_1$ (see FIG. 13) measured from the front of the toe box. The pivoting occurs from the base block (channel member 130). The interaction of the lateral support members and cross bar hinged together at pivot 114 provides a cantilever action that locks the boot in the binding.

The carriage arrangement provides lateral support members 112A and 112B that extend rearwardly and on which the sole of the boot rests. These members are unified with the top cross bar 154 that overrides the duckbill of the boot sole, so that when the user steps down on the lateral wings, a downward force is created over the toe of the boot. The cross bar 154 drives the boot sole downwardly against the stationary center block and particularly the raised pressure plate 136 with a mechanical advantage and sufficient force to effectively retain the boot in place.

Another feature of the present invention relates to the enhancement of grasping ability of the binding against the boot by virtue of extending the ends of the cross bar where these ends merge into the lateral support members. This provides enhanced gripping of the boot sole. This is illustrated in, for example, FIG. 16 where the end portion 175 extends rearwardly, represented by the dimension $D_3$ as measured from the line 171 (front of the toe box). The dimension $D_3$ may be in a range of 0.25 to 1.75 inches, and in the illustrated embodiment is about 0.75 inches.

A further feature of the present invention is the provision of stop pins, such as the pins 164 shown in FIG. 10. These pins not only position the forward position of the sole of the boot, but also these stop pins are positioned so as to locate the boot holes 139 in proper position relative to the three boot alignment pins 138. This enables proper alignment of the boot with the pins 138 when the user is stepping into the binding, such as in the position illustrated in FIG. 13.

The binding illustrated in the previous embodiments may also be used with a heel retention member as is illustrated in FIGS. 17 and 18. In some instances it may be desirable to provide a heel piece for more secure ski boot retention and to change the performance characteristics of the ski binding. This heel retention piece complements the step-in feature characteristic of the ski binding of the present invention. FIGS. 17 and 18 illustrate a relatively simple heel piece comprised of a heel clip assembly 204. The boot 155 is shown inserted into the binding 206 that is, in turn, supported on the ski 108.

The boot 155 is shown in FIG. 17 as located in position in the binding with the boot heel 176 engaged with the tail end of the heel piece 204. The curved heel engagement portion 282 of the shaped heel engagement member 280 engages with the ledge 177 on the heel 176, as illustrated in FIG. 17. The shaped heel engagement member 280 rests on the heel lift block 178. The heel clip assembly 204 is supported from the rear end of the lateral support members 112A and 112B, and more particularly from a lower upright wall of each member where the spacer bar 106 is supported therebetween, but just over the spacer bar 106, as shown in FIG. 17.

The heel clip assembly 204 attaches to the rear of the lateral support members by means of the hooked ends 234 that extend through holes 240 in the side flanges. A series of holes 240 may be provided such as three holes illustrated in FIG. 17. The hooked ends 234 may be positioned in any one of the holes 240 to adjust the position of the heel clip assembly 204. The shaped heel engagement member 280 then extends under the boot 155 to the rear of the boot where it is bent back toward the rear of the ski boot. The rear aspect of the heel assembly 204 is angled at approximately 45 degrees toward the ski boot to allow the heel of the ski boot to slide down this surface (curved boot engagement portion 282) and interlock with the ledge 177 when stepping into the ski binding.

The heel assembly 204 also includes a sliding spring mechanism that adjusts in length as a skier steps into the binding or as the boot is flexed forward into a telemark position. This mechanism includes threaded adjustable rods 228 having threads 229 that engage in the center block 226. The aforementioned hooked ends 234 are at the ends of the threaded rods 228. The combination of the center block and threaded rods enable adjustment of the relative position of the length of the heel assembly 204. The length of the heel assembly is adjusted by turning the threaded hooked members of the assembly. Springs 284 are positioned by the spring retention hooks 286 and provide a bias for the heel clip assembly 204.

Having now described a limited number of embodiments of the present invention, it should be now apparent to those skilled in the art that numerous embodiments, modifications and equivalents are contemplated as following within the scope of the present invention as defined by the appended claims. For example, the lateral boot support members and crossbar over the toe of the boot may be constructed as a single molded part that covers the whole front of the boot sole. Also, the lateral boot support members and upper cross bar could be constructed of bent sheet metal or injection molded material as a unitary part. The base of the binding and raised pressure plate could be molded as a unitary part. The outer channel member and inner plastic block that comprise the base could be a single molded part that then contains the spring pin and the ski brake. Use of this binding may include attachment of a heel retention device to the rear portion of the binding, or mounting this binding on a safety release plate. Heel retention devises and safety release plates are commercially available and of various designs.

What is claimed is:

1. A step-in binding for receiving a ski boot, comprising:

a base constructed and arranged to be secured to the ski;

a pair of boot support members pivotally supported from a front side of said base, and disposed laterally on either side of said base;

said pair of boot support members being biased to a boot receiving position and further having a locked position that is assumed once the boot is received, engages the pair of boot support members, and is cantilevered downwardly into the locked position;

a cross bar disposed between the pair of boot support members for engaging the front top of the boot;

a release lever arranged at the front of said base readily accessible to the skier and including a member that releases the pair of boot support members from the locked position to the boot receiving position upon activation of said release lever;

a first member supported by said base for interlocking with the bottom of the boot; and a second member for interlocking with a top of the boot.

2. A step-in binding as set forth in claim 1 wherein said base has a pressure plate on a front top surface that firmly engages an underside of the boot.

3. A step-in binding as set forth in claim 2 wherein the pressure plate is slightly elevated above the rest of the top surface of the base and said first member includes securing pins engageable in holes in the boot for retaining the boot in place.

4. A step-in binding as set forth in claim 3 including a pair of stop posts associated respectively with the pair of support members adapted to receive the front of the boot sole and for aligning the boot position with the securing pins.

5. A step-in binding as set forth in claim 1 wherein said second member includes one of a screw or ridge for engaging the top of the sole of the boot in front of the toe box.

6. A step-in binding as set forth in claim 5 wherein said screw is an adjustable set screw that engages an implanted stud in the boot sole.

7. A step-in binding as set forth in claim 1 including a cross piece extending transversely between the lateral support members at a forward position thereof and spaced rearwardly of the pivot axis of the lateral support members.

8. A step-in binding as set forth in claim 7 wherein the second member is supported by the cross piece and has a vertically disposed screw that can be adjusted to apply force to the top surface of the duckbill of the boot sole.

9. A step-in binding as set forth in claim 7 wherein the second member is supported by the cross piece and has a set screw that locks into an opposing set screw in the boot.

10. A step-in binding as set forth in claim 7 wherein the second member is supported by the cross piece and has a hooked member that locks into the upper surface of the boot sole.

11. A step-in binding as set forth in claim 1 including a ski brake integrated into the base and having wings that extend through the pair of lateral support members and a heel retention assembly supported from the rear of the lateral support members.

12. A step-in binding as set forth in claim 1 including a cross bar disposed transversely between the pair of boot support members for engaging the front top of the boot over the duckbill and the center of said cross bar receives the front of the toe box of the boot with the ends of the cross bar extending rearwardly by a distance in a range of 0.25 to 1.75 inches.

13. A step-in binding as set forth in claim 1 including a cross bar and wherein said lateral support members extending rearwardly from the center of said cross bar by a distance in a range on the order of 2.0 to 4.5 inches.

14. A step-in binding for receiving a ski boot for skiing, comprising:

a base including a center block constructed and arranged to be secured to the ski;

a pair of boot support members pivotally supported at a front side of said base, and disposed laterally on either side of said center block;

said lateral side members being tapered inwardly toward the front so as to receive and guide the ski boot as it is to be engaged;

said pair of boot support members being biased to a boot receiving position and further having a locked position that is assumed once the boot is received, engages the pair of boot support members, and is cantilevered downwardly into the locked position;

a cross bar disposed transversely between the pair of boot support members for engaging the front top of the boot over the duckbill; and a release lever arranged at the front of said base readily accessible to the skier and including a member that releases the pair of boot support members from the locked position to the boot receiving position upon activation of said release lever;

the center of said cross bar receiving the front of the toe box of the boot and the ends of the cross bar extending rearwardly by a distance in a range of 0.25 to 1.75 inches;

wherein the dimension from the cross piece to the ends of the lateral support members is on the order of 2.0 to 4.5 inches.

15. A step-in binding as set forth in claim 14 wherein said center block has a pressure plate on a front top surface that firmly engages an underside of the boot, and wherein the pressure plate is slightly elevated above the rest of the top surface of the base and includes securing pins engageable in holes in the boot for retaining the boot in place.

16. A step-in binding as set forth in claim 14 wherein a cross piece extends transversely between the lateral support members at a forward position thereof and is spaced rearwardly of the pivot axis of the lateral support members by a dimension on the order of 0.75 to 2.25 inches.

17. A step-in binding for receiving a ski boot, comprising:

a base constructed and arranged to be secured to the ski;

a pair of boot support members pivotally mounted from a front side of said base, disposed laterally on either side of said base and extending rearwardly;

said lateral side members adapted to receive and guide the ski boot as it is received;

said pair of boot support members being biased to a boot released position and further having a locked position that is assumed once the boot is received, engages the pair of boot support members, and is cantilevered downwardly into the locked position;

a cross bar disposed transversely between the pair of boot support members for engaging the front top of the boot toe box over the duckbill; and a release lever mounted at the front of said base, readily accessible to the skier and including a release member that releases the pair of boot support members from the locked position to the boot released position upon activation of said release lever;

said lateral support members extending rearwardly from the center of said cross bar by a distance in a range on the order of 2.0 to 4.5 inches.

18. A step-in binding as set forth in claim 17 wherein the center of said cross bar receives the front of the toe box of the boot and the ends of the cross bar extending rearwardly by a distance in a range of 0.25 to 1.75 inches.

19. A step-in binding as set forth in claim 18 wherein the center of said cross bar is spaced rearwardly of the pivot axis of the lateral support members by a dimension on the order of 0.75 to 2.25 inches.

20. A step-in binding for receiving a ski boot, comprising:

a base constructed and arranged to be secured to the ski;

and a carriage pivotally supported from a front side of said base and comprising;

a pair of boot support members that are respectively disposed at opposed sides of said base and that are adapted to receive the sole of the ski boot, said boot support members having locked and released positions, and an overlying member that pivots with the pair of boot support members, is disposed over the base and engages a top surface of the sole of the ski boot when the ski boot is inserted into the carriage, said carriage, upon receiving said boot, being cantilevered downwardly from the released position to the locked position wherein the sole of the ski boot is clamped by the overlying member against the fixed position base, and further including a ski brake integrated into the base and having opposite legs that engage with respective boot support members, releasable when the boot is disengaged, and constructed and arranged to urge the carriage from the locked position to the released position.

21. A step-in binding as set forth in claim 20 wherein there is first member supported by said base for engaging or interlocking with the bottom of the boot; and a second member supported by the carriage for engaging or interlocking with a top of the boot.

22. A step-in binding as set forth in claim 21 wherein the top front surface of the base is elevated above the rest of the top surface of the base to firmly engage the underside of the boot.

23. A step-in binding as set forth in claim 21 wherein said first member includes securing means comprising at least one securing pin engageable in the boot sole for retaining the boot in place.

24. A step-in binding as set forth in claim 20 wherein said second member includes securing means comprising at least one of a screw and ridge for engaging the top of the sole of the boot in front of the toe box.

25. A step-in binding as set forth in claim 21 wherein the engagement surfaces of the first and second members are at a greater distance apart when the carriage is in the released position, which allows clearance for the engagement means when the boot is inserted into the carriage; and the carriage is cantilevered downward into a locked position reducing the clearance between the engagement surfaces in the first and second members, firmly holding the boot in place.

26. A step-in binding as set forth in claim 20 wherein said overlying member includes a cross piece extending transversely between the boot support members at a forward position thereof and spaced rearwardly of the pivot axis of the boot support members.

27. A step-in binding as set forth in claim 26 wherein the boot support members flare in an outward and rearward direction forming a platform on which the boot sole rests.

28. A step-in binding as set forth in claim 26 wherein the second member is supported by the cross piece and has engagement means comprising at least one of a vertically disposed screw and ridge that applies a force to the top surface of the duckbill of the boot sole when the carriage is cantilevered in a downward or locked position.

29. A step-in binding as set forth in claim 26 wherein the second member is supported by the cross piece and has interlocking means comprising at least one of a screw and ridge that locks into an opposing means comprising at least one of a screw and ridge in the top surface of the duckbill of boot.

30. A step-in binding as set forth in claim 20 wherein said overlying member includes a cross bar disposed transversely between the pair of boot support members for engaging the front top of the boot over the duckbill and the center of said cross bar receives the front of the toe box of the boot with the ends of the cross bar extending rearwardly by a distance in a range of 0.25 to 1.75 inches.

31. A step-in binding as set forth in claim 20 wherein said overlying member includes a cross bar and wherein said lateral support members extending rearwardly from the center of said cross bar by a distance in a range on the order of 2.0 to 4.5 inches.

32. A step-in binding for receiving a ski boot, comprising: a base constricted and arranged to be secured to the ski; and a carriage pivotally supported from a front side of said base and comprising; a pair of boot support members that are respectively disposed at opposed sides of said base and that are adapted to receive the sole of the ski boot, said boot support members having locked and released positions, and an overlying member that pivots with the pair of boot support members, is disposed over the base and engages a top surface of the sole of the ski boot when the ski boot is inserted into the carriage, said carriage, upon receiving said boot, being cantilevered downwardly from the released position to the locked position wherein the sole of the ski boot is clamped by the overlying member against the fixed position base; wherein the center of said overlying member receives the front of the toe box of the boot and the engagement surfaces of the overlying member extending rearwardly by a distance in a range of 0.25 to 1.75 inches wherein the base has an elevated front top surface to firmly engage the underside of the boot.

33. A step-in binding as set forth in claim 32 wherein there is first member supported by said base for engaging or interlocking with the bottom of the boot; and a second member supported by the carriage for engaging or interlocking with a top of the boot.

34. A step-in binding for receiving a ski boot, comprising: a base constructed and arranged to be secured to the ski; and a carriage pivotally supported from a front side of said base and comprising; a pair of boot support members that are respectively disposed at opposed sides of said base and that are adapted to receive the sole of the ski boot, said boot support members having locked and released positions, and an overlying member that pivots with the pair of boot support members, is disposed over the base and engages a top surface of the sole of the ski boot when the ski boot is inserted into the carriage, said carriage, upon receiving said boot, being cantilevered downwardly from the released position to the locked position wherein the sole of the ski boot is clamped by the overlying member against the fixed position base; wherein the center of said overlying member receives the front of the toe box of the boot and the engagement surfaces of the overlying member extending rearwardly by a distance in a range of 0.25 to 1.75 inches wherein the boot support members flare in an outward and rearward direction forming a platform on which the boot sole rests.

35. A step-in binding as set forth in claim 32 wherein said overlying member includes a cross piece extending transversely between the boot support members at a forward position thereof and spaced rearwardly of the pivot axis of the boot support members.

36. A step-in binding as set forth in claim 33 wherein the first member is supported by the base and vertically dispose above the front top surface of the base; and interlocks with the duckbill of the boot sole when the carriage is cantilevered in a downward or locked position.

37. A step-in binding as set forth in claim 33 wherein the second member is supported by the carriage and vertically dispose below the cross piece of the carriage; and interlocks with the duckbill of the boot sole when the carriage is cantilevered in a downward or locked position.

38. A step-in binding as set forth in claim 33 wherein said first member includes securing means comprising at least one securing pin, ridge engageable in the boot sole for retaining the boot in place.

39. A step-in binding as set forth in claim 33 wherein said second member includes securing means comprising at least one of a screw, stud, hook, ridge engageable in the duckbill of the boot.

40. A step-in binding as set forth in claim 33 wherein the second member is supported by the carriage and has a hooked member that locks into the duckbill of the boot.

41. A step-in binding as set forth in claim 33 wherein the engagement surfaces of the first and second members are at a greater distance apart when the carriage is in the released position, which allows clearance for the engagement means when the boot is inserted into the carriage; and the carriage is cantilevered downward into a locked position reducing the clearance between the engagement surfaces in the first and second members, firmly holding the boot in place.

42. A step-in binding as set forth in claim 33 wherein the second member is supported by the carriage and has engagement means that applies a force to a top surface of the duckbill of the boot when the carriage is cantilevered in a downward or locked position.

43. A step-in binding as set forth in claim 33 wherein the second member is supported by the carriage and has interlocking means comprising at least one of a stud, hook or, ridge that locks into an opposing means comprising at least one of a screw, stud, hook or, ridge in the duckbill of boot.

44. A step-in binding as set forth in claim 32 including a ski brake integrated into the base and having opposite legs that engage with respective boot support members, releasable when the boot is disengaged, and constructed and arranged to urge the carriage from the locked position to the released position.

45. A step-in binding for receiving a ski boot, comprising:

a fixed position base constructed and arranged to be secured to the ski;

a carriage pivotally mounted from a front side of said base; the carriage containing pair of boot support members that are respectively disposed at opposed sides of said base and extend rearwardly forming a platform on which the boot sole rests, and an overlying cross member that engages with a top surface of the boot sole that pivots in unison with the laterally disposed boot support members;

said carriage being biased to a boot released position and further having a locked position that is assumed once the boot is received, engages the carriage and is cantilevered downwardly into the locked position forcing the boot against the fixed position base; and cross member in said carriage is spaced rearwardly of the pivot axis by a dimension on the order of 0.75 to 2.25 inches.

46. A step-in binding as set forth in claim 45 wherein the overlying member supported by the carriage and has engagement means that interlocks with a top surface of the duckbill of the boot when the carriage is cantilevered in a downward or locked position.

47. A step-in binding as set forth in claim 45 including a ski brake integrated into the base and having opposite legs that engage with respective boot support members, releasable when the boot is disengaged, and constructed and arranged to urge the carriage from the locked position to the released position.

48. A step-in binding for receiving a ski boot, comprising:

a base constructed and arranged to be secured to the ski;

a carriage pivotally mounted from a front side of said base;

the carriage containing a pair of boot support members that are respectively disposed at opposed sides of said base and extended rearward forming a platform on which the boot sole rests, and a cross bar that engages with a top surface of the boot sole that pivots in unison with the laterally disposed boot support members;

said carriage being biased to a boot released position and further having a locked position that is assumed once the boot is received, engages the carriage and is cantilevered downwardly into the locked position forcing the boot against a ton surface of the base wherein said boot support members extend rearwardly from the center of said cross bar by a distance in a range on the order of 2.0 to 4.5 inches.

49. A step-in binding for receiving a ski boot, comprising:

a base constructed and arranged to be secured to the ski;

a carriage pivotally mounted from a front side of said base;

the carriage containing a pair of boot support members that are respectively disposed at opposed sides of said base and extended rearward forming a platform on which the boot sole rests, and a cross bar that engages with a top surface of the boot sole that pivots in unison with the laterally disposed boot support members;

said carriage being biased to a boot released position and further having a locked position that is assumed once the boot is received, engages the carriage and is cantilevered downwardly into the locked position forcing the boot against a top surface of the base wherein the base has an elevated top surface to firmly engage the underside of the boot.

50. A step-in binding as set forth in claim 49 including engagement means supported by the carriage and for engagement with a top surface of the duckbill of the boot when the carriage is cantilevered in a downward or locked position.

51. A step-in binding for receiving a ski boot, comprising:

a base constructed and arranged to be secured to the ski;

a carriage pivotally mounted from a front side of said base;

the carriage containing a pair of boot support members that are respectively disposed at opposed sides of said base and extended rearward forming a platform on which the boot sole rests, and a cross bar that engages with a top surface of the boot sole that pivots in unison with the laterally disposed boot support members;

said carriage being biased to a boot released position and further having a locked position that is assumed once the boot is received, engages the carriage and is cantilevered downwardly into the locked position forcing the boot against a top surface of the base wherein the cross bar is supported by the carriage and has engagement means that interlocks with a top surface of the duckbill of the boot when the carriage is cantilevered in a downward or locked position.

52. A step-in binding for receiving a ski boot, comprising:

a base constructed and arranged to be secured to the ski;

a carriage pivotally mounted from a front side of said base;

the carriage containing a pair of boot support members that are respectively disposed at opposed sides of said base and extended rearward forming a platform on which the boot sole rests, and a cross bar that engages with a top surface of the boot sole that pivots in unison with the laterally disposed boot support members;

said carriage being biased to a boot released position and further having a locked position that is assumed once the boot is received, engages the carriage and is cantilevered downwardly into the locked position forcing the boot against a top surface of the base including a ski brake integrated into the base and having opposite legs that engage with respective boot support members, releasable when the boot is disengaged, and constructed and arranged to urge the carriage from the locked position to the released position.

53. A step-in binding for receiving a ski boot, comprising:

a base constructed and arranged to be secured to the ski;

a carriage pivotally mounted from a front side of said base;

the carriage containing a pair of boot support members that are respectively disposed at opposed sides of said base and extended rearward forming a platform on which the boot sole rests, and a cross bar that engages with a top surface of the boot sole that pivots in unison with the laterally disposed boot support members;

said carriage being biased to a boot released position and further having a locked position that is assumed once the boot is received, engages the carriage and is cantilevered downwardly into the locked position forcing the boot against a top surface of the base;

wherein there is a first member supported by said base for engaging or interlocking with the bottom of the boot;

wherein there is a second member supported by the carriage for engaging or interlocking with the top of the boot;

wherein the first member is supported by the base and vertically disposed above the front top surface of the base; and interlocks with the duckbill of the boot sole when the carriage is cantilevered in a downward or locked position;

wherein the second member is supported by the carriage and vertically disposed below the cross bar of the carriage; and interlocks with the duckbill of the boot sole when the carriage is cantilevered in a downward or locked position.

54. A step-in binding as set forth in claim 53 wherein the second member is supported by the carriage and has engagement means that applies a force to a top surface of the duckbill of the boot when the carriage is cantilevered in a downward or locked position.

* * * * *

UNITED STATES PATENT AND TRADEMARK OFFICE

CERTIFICATE OF CORRECTION

PATENT NO. : 7,210,698 B2
APPLICATION NO. : 10/799305
DATED : May 1, 2007
INVENTOR(S) : Louis Dandurand It is certified that error appears in the above-identified patent and that said Letters Patent is hereby corrected as shown below:

Column 17, line 29, “constricted” should read --constructed--.

Column 19, line 33, “ton” should read --top--.

Signed and Sealed this

Twenty-third Day of October, 2007

JON W. DUDAS
*Director of the United States Patent and Trademark Office*